US009497561B1

(12) United States Patent
Khabbazibasmenj et al.

(10) Patent No.: US 9,497,561 B1
(45) Date of Patent: Nov. 15, 2016

(54) WAVE FIELD SYNTHESIS BY SYNTHESIZING SPATIAL TRANSFER FUNCTION OVER LISTENING REGION

(71) Applicant: Mass Fidelity Inc., Toronto (CA)

(72) Inventors: Arash Khabbazibasmenj, North York (CA); Benjamin George Webster, Kelowna (CA); Joseph David Caci, Waterloo (CA)

(73) Assignee: MASS FIDELITY INC., Toronto (CA)

( * ) Notice: Subject to any disclaimer, the term of this patent is extended or adjusted under 35 U.S.C. 154(b) by 0 days.

(21) Appl. No.: 15/167,906

(22) Filed: May 27, 2016

(51) Int. Cl.
*H04S 7/00* (2006.01)
*H04S 3/00* (2006.01)
*H04R 5/02* (2006.01)

(52) U.S. Cl.
CPC . *H04S 7/30* (2013.01); *H04R 5/02* (2013.01); *H04S 3/008* (2013.01); *H04S 2420/13* (2013.01)

(58) Field of Classification Search
CPC ..... H04S 7/302
USPC ..... 381/17, 300, 303, 309, 310, 320, 444
See application file for complete search history.

(56) References Cited

U.S. PATENT DOCUMENTS 5,386,475 A * 1/1995 Birck ..... H04R 25/70 381/320
2004/0109570 A1* 6/2004 Bharitkar ..... H04S 7/302 381/17
2007/0019812 A1* 1/2007 Kim ..... H04S 1/00 381/17

* cited by examiner

*Primary Examiner* — Md S Elahee
(74) *Attorney, Agent, or Firm* — Knobbe, Martens, Olson & Bear, LLP

(57) ABSTRACT

Broadly speaking, the technology relates to using wave field synthesis theory to simulate one or more idealized virtual point sources in a multi-speaker system. The speaker transfer function of each speaker is modeled, and the values and directional gradient of the combined speaker transfer function at test points in a convexly-bounded listening region are compared to the desired values and directional gradient for the idealized transfer function of the idealized virtual point source(s) at the test points to determine filter coefficient sets for each filter. The determined filter coefficients are those which minimize the total difference between the values and directional gradient of the combined speaker transfer function and the values and directional gradient of the idealized transfer function of the idealized virtual point source across all the test points for a plurality of frequency bins.

24 Claims, 20 Drawing Sheets

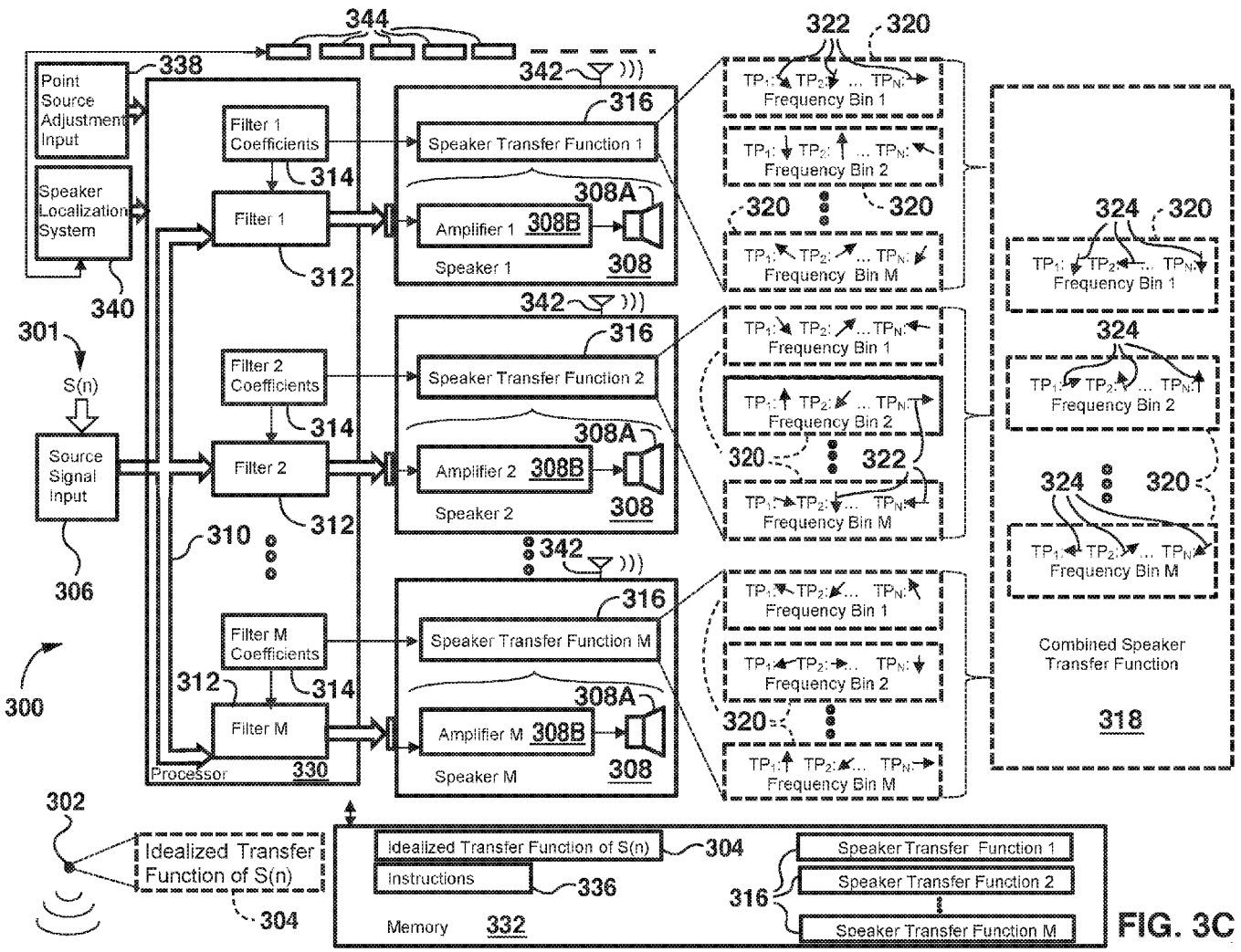
Combined Speaker Transfer Function
318
Frequency Bin 1
Frequency Bin 2
Frequency Bin M
Speaker Transfer Function 1
Speaker Transfer Function 2
Speaker Transfer Function M
Amplifier 1
Amplifier 2
Amplifier M
Speaker 1
Speaker 2
Speaker M
Filter 1 Coefficients
Filter 2 Coefficients
Filter M Coefficients
Filter 1
Filter 2
Filter M
Processor
Point Source Adjustment Input
Speaker Localization System
Source Signal Input
S(n)
Idealized Transfer Function of S(n)
Instructions
Memory
FIG. 3C

WAVE FIELD SYNTHESIS BY SYNTHESIZING SPATIAL TRANSFER FUNCTION OVER LISTENING REGION

TECHNICAL FIELD

The present disclosure relates to wave field synthesis technology, and more particularly to simulating one or more virtual point sources in a multi-speaker sound system.

BACKGROUND

Wave field synthesis is a sound wave field reproduction technique that overcomes the limitations of conventional surround sound methods. The essence of wave field synthesis is the synthesis of the physical properties of an acoustic wave field through a set of speakers within an extended listening region. The extended listening region is the main advantage of sound field reproduction with respect to other consumer standards such as stereophony or 5.1 systems.

The Kirchhoff-Helmholtz theorem is the main principle behind wave field synthesis. Based on this theorem, at any listening point within a source-free extended listening region, any arbitrary acoustic wave field can be uniquely determined if both the sound pressure and its directional gradient on the surface enclosing this listening region are known. More specifically according to this theorem, any arbitrary acoustic wave field can be synthesized by generating the sound pressure distribution of the target wave field and its directional gradient by monopole and dipole speakers, respectively, that have been distributed on the surface of the listening region.

According to the Kirchhoff-Helmholtz theorem, the precise synthesis of an acoustic wave field requires an infinite number of monopole and dipole speakers that have been distributed on the surface of the listening region. Of course, in reality the number of speakers must be finite, resulting in an approximation that introduces inaccuracies into the synthesized sound wave field as compared to the target wave field that corresponds to the virtual point source(s). More specifically, such approximation implies a spatial sampling process that results in spatial aliasing artifacts. Spatial sampling limits the exact reproduction of the target sound wave field to a given upper frequency referred to as the Nyquist frequency. Another practical problem is the assumption that speakers are ideal monopole and dipole speakers. However, in reality this assumption does not generally hold.

SUMMARY

Broadly speaking, the technology relates to using wave field synthesis theory to simulate one or more idealized virtual point sources in a multi-speaker system. The speaker transfer function of each speaker is modeled, and the values and directional gradient of the combined speaker transfer function at test points in a convexly-bounded listening region are compared to the desired values and directional gradient for the idealized transfer function of the idealized virtual point source(s) at the test points to determine filter coefficient sets for each filter. The determined filter coefficients are those which minimize the total difference between the values and directional gradient of the combined speaker transfer function and the values and directional gradient of the idealized transfer function of the idealized virtual point source across all the test points for a plurality of frequency bins.

In one aspect, a multi-speaker sound system to simulate at least one idealized virtual point source, the system includes at least one source signal input adapted to receive a respective source signal, there being one source signal input associated with each idealized virtual point source, a plurality of speakers and a plurality of filters. Each of the speakers is coupled to each source signal input by a respective parallel circuit to direct each respective source signal toward each speaker, and each filter is associated with a single speaker and a single source signal input and is interposed between its respective speaker and its respective source signal input to filter the respective source signal. Each filter has a respective filter coefficient set, and each speaker has a speaker transfer function for each source signal input. Each speaker transfer function for a particular speaker and a particular source signal input represents that speaker's beam pattern as a function of the respective filter coefficient set of the filter associated with that particular speaker and that particular source signal input. The multi-speaker sound system has a combined speaker transfer function for each source signal input. Each combined speaker transfer function for a particular source signal input is a summation in space of the speaker transfer functions of the speakers for that source signal input and represents superpositioned speaker transfer functions of the speakers at notional test points within a notional convexly-bounded listening region. For each combined speaker transfer function, the filter coefficients have respective values that globally minimize in frequency domain, across at least a subset of all frequency bins below a sampling frequency limit, across a frequency-sufficient set of the notional test points having known test point positions relative to notional source positions of the speakers, a total difference between that particular combined speaker transfer function and an idealized transfer function of that particular idealized virtual point source at a specified notional position of that idealized virtual point source relative to the notional source positions of the speakers.

In some embodiments, the notional convexly-bounded listening region is planar. In particular embodiments, the notional convexly-bounded listening region is circular.

In certain embodiments, the speakers may be secured to a carrier with fixed spatial positions relative to one another. In some such embodiments each idealized virtual point source may have a predefined fixed position and the filters are preconfigured with their respective filter coefficients. In other such embodiments, the system may further include at least one processor coupled to the filters and at least one memory coupled to the at least one processor, which memory stores test point impingement information representing, across at least a subset of all frequency bins below the sampling frequency limit, at least for each test point in the frequency-sufficient set of the notional test points, combined speaker transfer function values at the test points and combined speaker transfer function gradient vector values at the test points. The at least one memory further stores the idealized transfer function of each idealized virtual point source. At least one point source adjustment input is coupled to the processor and adapted to provide the specified notional position of each idealized virtual point source to the processor, and the at least one memory stores instructions which, when executed by the processor, cause the processor to receive, from the at least one point source adjustment input, the specified notional position of that idealized virtual point source, evaluate the idealized transfer function of that idealized virtual point source for the specified notional position of that idealized virtual point source, determine, for each source signal input, a set of filter coefficient values that globally minimize in frequency domain, across at least a subset of all frequency bins below a sampling frequency limit, across the frequency-sufficient set of the notional test points, the total difference between the combined speaker transfer function and the idealized transfer function of the idealized virtual point source associated with that particular source signal input at a specified notional position of that idealized virtual point source, and configure the filters to have the determined coefficient values.

The test point impingement information may include one or more of at least the inherent transfer function components of the speaker transfer functions, and the combined speaker transfer function, whereby the test point impingement information represents the combined speaker transfer function values at the test points by enabling calculation of the combined speaker transfer function values for any arbitrary group of test points. Where the test point impingement information comprises the combined speaker transfer function, the test point impingement information may represent the combined speaker transfer function gradient vector values at the test points by enabling calculation of the combined speaker transfer function gradient values at the test points for any arbitrary group of test points.

The test points may be pre-defined test points, and the test point impingement information may represent the combined speaker transfer function values at the test points using pre-calculated test point transfer functions for each test point. The test point impingement information may represent the combined speaker transfer function gradient vector values at the test points using pre-calculated test point transfer function gradient vectors for each test point.

In certain other embodiments, the system may further comprise at least one processor coupled to the filters and at least one memory coupled to the at least one processor, with the at least one memory storing the speaker transfer functions and the idealized transfer function of each idealized virtual point source. At least one point source adjustment input is coupled to the processor and adapted to provide the specified notional position of each idealized virtual point source to the processor, and a speaker localization system is coupled to the at least one processor and adapted to determine the notional source positions of the speakers and provide the notional source positions of the speakers to the at least one processor. The at least one memory stores instructions which, when executed by the processor, cause the processor to receive, from the speaker localization system, the notional source positions of the speakers, determine the combined speaker transfer function for each source signal input from the notional source positions of the speakers, receive, from the at least one point source adjustment input, the specified notional position of each idealized virtual point source, evaluate the idealized transfer function of each idealized virtual point source for the specified notional position of that idealized virtual point source, determine, for each source signal input, a set of filter coefficient values that globally minimize in frequency domain, across at least a subset of all frequency bins below a sampling frequency limit, across the frequency-sufficient set of the notional test points, the total difference between the combined speaker transfer function and the idealized transfer function of the idealized virtual point source at the specified notional position of the idealized virtual point source associated with that particular source signal input, and configure the filters to have the determined coefficient values.

In another aspect, a method for optimizing a multi-speaker sound system to simulate at least one idealized virtual point source comprises receiving, at least one processor, a first specified notional position of a first idealized virtual point source relative to notional source positions of the speakers and determining, by the at least one processor, a first respective optimal filter coefficient set for each speaker by determining a first set of filter coefficients which use a combined speaker transfer function of the speakers to simulate a first idealized transfer function of the first idealized virtual point source. The combined speaker transfer function represents superpositioned speaker transfer functions of the speakers at notional test points within a notional convexly-bounded listening region, with the notional test points having known test point positions relative to notional source positions of the speakers. Determining the first set of filter coefficients includes determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the first idealized transfer function of the first idealized virtual point source at the first specified notional position of the first idealized virtual point source. The method further includes setting, by the processor, the first filter coefficients for the speakers to the respective values in the first set of filter coefficients.

In some implementations of the method, the notional convexly-bounded listening region is planar, and in particular implementations, the notional convexly-bounded listening region is circular.

In some implementations, the combined speaker transfer function is a predefined function based on fixed notional source positions of the speakers relative to one another.

In other implementations, the method further includes determining, by the at least one processor, the notional source positions of the speakers relative to one another, and the at least one processor using the determined notional source positions of the speakers relative to one another to determine the combined speaker transfer function of the speakers.

In some embodiments, the at least one idealized virtual point source is a single virtual point source.

In other embodiments, the at least one idealized virtual point source is two virtual point sources. In such embodiments, the method further includes receiving, at the at least one processor, a second specified notional position of a second idealized virtual point source relative to the notional source positions of the speakers and determining, by the at least one processor, a second respective optimal filter coefficient set for each speaker by determining a second set of filter coefficients which use the combined speaker transfer function to simulate a second idealized transfer function of the second idealized virtual point source. Determining the second set of filter coefficients includes determining a set of filter coefficients whose respective values globally minimize in frequency domain, across at least a subset of all frequency bins below a sampling frequency limit, across the frequency-sufficient set of the notional test points, a total difference between the combined speaker transfer function and the second idealized transfer function of the second idealized virtual point source at the second specified notional position of the second idealized virtual point source. The method further includes setting, by the processor, the second filter coefficients for the speakers to the respective values in the second set of filter coefficients.

In yet other embodiments, the at least one idealized virtual point source is three virtual point sources. In such embodiments, the method further includes receiving, at the at least one processor, a second specified notional position of a second idealized virtual point source relative to the notional source positions of the speakers and determining, by the at least one processor, a second respective optimal filter coefficient set for each speaker by determining a second set of filter coefficients which use the combined speaker transfer function to simulate a second idealized transfer function of the second idealized virtual point source. Determining the second set of filter coefficients includes determining a set of filter coefficients whose respective values globally minimize in frequency domain, across at least a subset of all frequency bins below a sampling frequency limit, across the frequency-sufficient set of the notional test points, a total difference between the combined speaker transfer function and the second idealized transfer function of the second idealized virtual point source at the second specified notional position of the second idealized virtual point source. The method further includes setting, by the processor, the second filter coefficients for the speakers to the respective values in the second set of filter coefficients. The method still further includes receiving, at the at least one processor, a third specified notional position of a third idealized virtual point source relative to the notional source positions of the speakers and determining, by the at least one processor, a third respective optimal filter coefficient set for each speaker by determining a third set of filter coefficients which use the combined speaker transfer function to simulate a third idealized transfer function of the third idealized virtual point source. Determining the third set of filter coefficients includes determining a set of filter coefficients whose respective values globally minimize in frequency domain, across at least a subset of all frequency bins below a sampling frequency limit, across the frequency-sufficient set of the notional test points, a total difference between the combined speaker transfer function and the third idealized transfer function of the third idealized virtual point source at the third specified notional position of the third idealized virtual point source. The method further includes setting, by the processor, the third filter coefficients for the speakers to the respective values in the third set of filter coefficients.

In still further embodiments, the at least one idealized virtual point source is four or more idealized virtual point sources.

In some embodiments, determining the set of filter coefficients whose respective values globally minimize in frequency domain, across at least a subset of all frequency bins below a sampling frequency limit, across the frequency-sufficient set of the notional test points, a total difference between the combined speaker transfer function and the first idealized transfer function of the first idealized virtual point source at the first specified notional position of the first idealized virtual point source includes determining a solution to a convex optimization problem. The solution may be a convergently iterative numerical solution, or may be a closed form solution.

BRIEF DESCRIPTION OF THE DRAWINGS

These and other features will become more apparent from the following description in which reference is made to the appended drawings wherein:

FIG. 3C shows a third embodiment of the sound system of FIG. 3 in which the speakers have variable spatial positions relative to one another and an idealized virtual point source has a variable position relative to the speakers;

DETAILED DESCRIPTION

The present disclosure is directed to a practical implementation of the wave-field synthesis theory by synthesizing the audio field of a virtual point source inside a smaller region which is a subset of the region defined by the set of speakers. Particularly, instead of ideal monopole and dipole speakers on the boundaries of the listening region, the present disclosure contemplates a set of real physical speakers with any arbitrary but known spatial transfer functions (referred to herein as "speaker transfer functions") and a notional convexly-bounded listening region within the region defined by the set of speakers. The speaker transfer function of a speaker is defined as the frequency response of that speaker at any given point in the space. The speaker transfer function of a speaker is a combination of an inherent transfer function of the speaker, based on the inherent physical and electronic properties of the speaker, as modified by pre-filtering, if any, of the input audio signal fed to the speaker.

According to one embodiment, a set of finite impulse response (FIR) filters (each associated with one speaker) is configured so that a combined speaker transfer function of the speakers (i.e., superposition of the speaker transfer functions inside the notional convexly-bounded listening region) becomes as close as possible to the transfer function of an arbitrary virtual point source inside the notional convexly-bounded listening region. By applying wave-field synthesis theory, this goal can be achieved by synthesizing the spatial transfer function of the virtual point source (referred to as an "idealized transfer function" for that virtual point source) and its directional gradient over the boundaries of the notional convexly-bounded listening region. As will be demonstrated below, at a fixed frequency, the idealized transfer function of an arbitrary virtual point source (or its directional gradient) can be precisely synthesized if the combined speaker transfer function (or its directional gradient) of the set of speakers is equal to that of the virtual point source at a certain number of discrete points over the boundaries due to the sampling theorem.

Based on the latter fact, the FIR filters can be configured in such a way that the total deviation between the combined speaker transfer function and the idealized transfer function of an arbitrary virtual point source as well as their corresponding directional gradients over a set of discrete points (on the boundaries of the notional convexly-bounded listening region) and over a fine grid of frequencies is minimized. The corresponding resulting optimization problem is a convex problem for which the globally optimal solution can found in a closed-form.

Figure 1A:
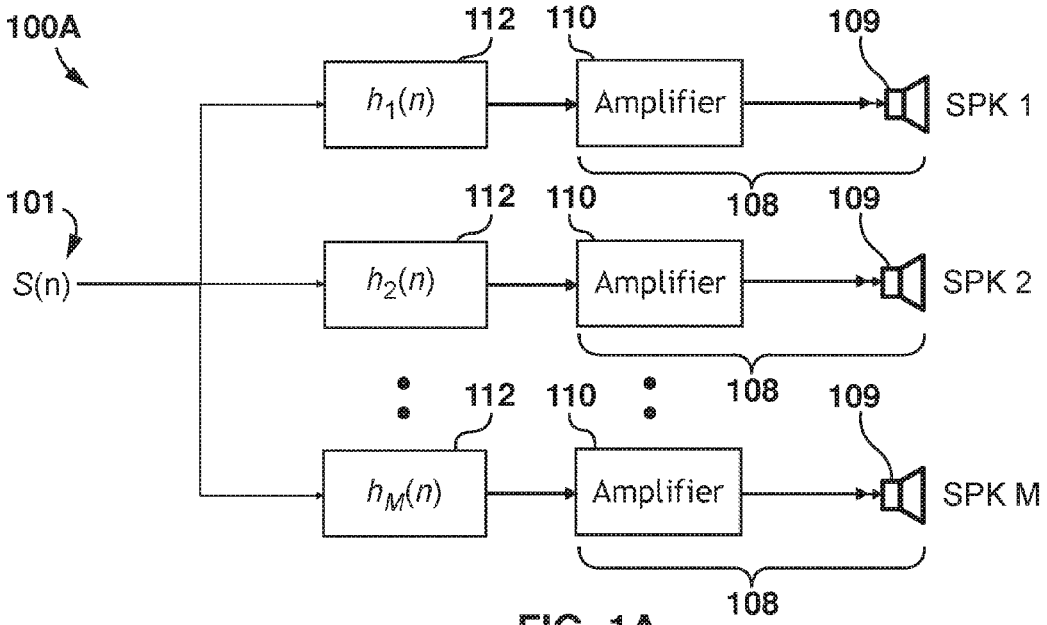
FIG. 1A is a schematic representation of a first exemplary signal processing system for multiple speakers having a single source signal S(n) according to an aspect of the present disclosure.

The present disclosure will describe in detail methods and apparatus for implementing a system having at least one single virtual point source and a plurality of M speakers each of which is equipped with an adjustable FIR filter. Referring first to FIG. 1A, a first exemplary signal processing system for multiple speakers is shown schematically at reference 100A. The first exemplary signal processing system 100A receives a single source signal S(n) 101 representing a virtual point source, and has a plurality of speakers 108, each comprising speaker hardware 109 and an amplifier 110, which are coupled in parallel to the source signal S(n) 101. The amplifier 110 may be a separate device, or may be integrated into the respective speaker 108. The system 100A further includes a plurality of filters 112 having filter coefficients denoted as $h_1(n)$, $h_2(n)$, . . . $h_M(n)$, with each filter 112 being associated with a single speaker 108 and interposed between its respective speaker 108 and the source signal S(n) to filter the source signal S(n). The filters 112 may, for example be implemented within a computer processor which then transmits the filtered source signal S(n) 101, or may be implemented within the speakers 108, with the filter coefficients being passed to the speakers 108 after calculation by a processor.

Figure 1B:
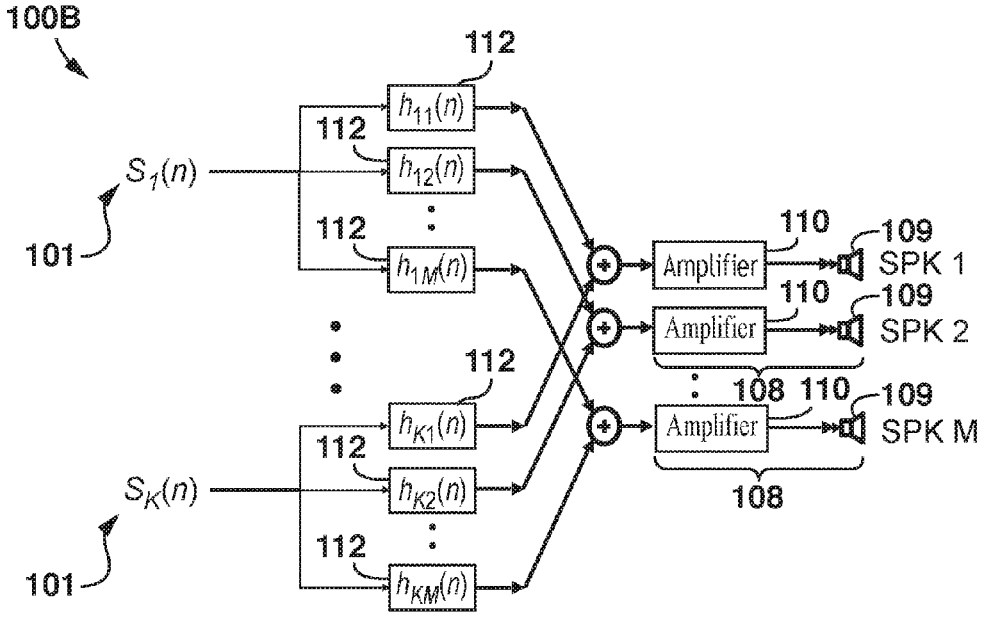
FIG. 1B is a schematic representation of a second exemplary signal processing system for multiple speakers having a plurality of K source signals.

The methods and apparatus described herein can be adapted and extended to encompass arrangements incorporating any arbitrary plurality of K source signals representing K virtual point sources, as shown in FIG. 1B. In FIG. 1B, a second exemplary signal processing system for multiple speakers is shown schematically at reference 100B, in which a plurality of speakers 108, each comprising speaker hardware 109 and an amplifier 110, are coupled in parallel to a plurality of K source signals $S_1(n)$ . . . $S_K(n)$ 101 with each source signal $S_1(n)$ . . . $S_K(n)$ 101 representing a respective virtual point source. In the second exemplary signal processing system 100B, each speaker 108 has K filters 112; that is, one filter 112 for each of the K source signals $S_1(n)$ . . . $S_K(n)$ 101. Each filter 112 is associated with a single speaker 108 and a single source signal St(n) . . . $S_K(n)$ 101 and is interposed between its respective speaker 108 and its respective source signal $S_1(n)$ . . . $S_K(n)$ 101 to filter the respective source signal 101. The filtered signals for each speaker 108 are summed for each speaker 108 and then fed to the respective amplifier 110.

As has been illustrated in FIGS. 1A and 1B, the audio input representing the virtual point source is initially filtered by the associated filter of each speaker and the filtered audio signal is then fed into the respective speaker.

Figure 2:
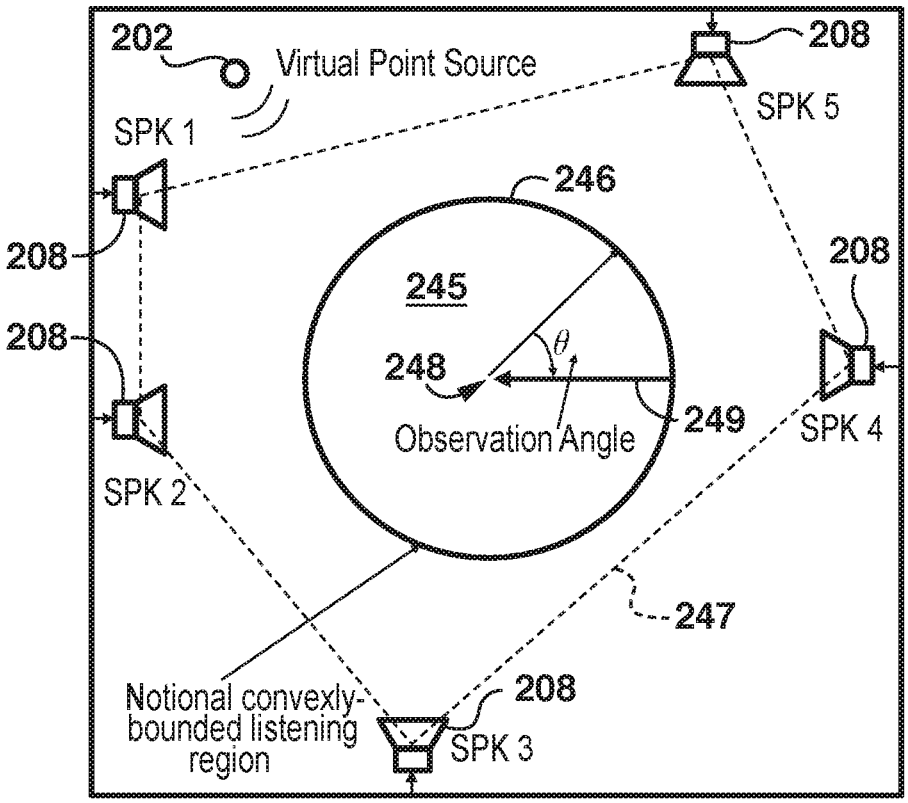
FIG. 2 shows an arrangement of speakers to define a notional convexly-bounded listening region.

Referring now to FIG. 2, the objective is to configure the filter coefficients in such a way that the overall frequency response of the speakers 208 as perceived inside a notional convexly-bounded listening region 245 becomes as close as possible to that of a virtual point source 202. As can be seen, the speakers 208 are generally aimed toward the notional convexly-bounded listening region 245 (the amplifiers and speaker hardware are not shown separately in FIG. 2). The speakers 208 do not need to be aimed in any particular direction since the speaker transfer functions will capture the orientation. In order to simplify the description, the foregoing explanation will be directed to a case in which the speakers 208 are assumed to be located at the same level as the listener's ears, in other words, the notional convexly-bounded listening region 245 is assumed to be planar, i.e. a notional convexly-bounded planar listening area 245. Thus, for the illustrated embodiments the notional convexly-bounded listening region 245 is assumed to be a planar region bounded by a convex curve 246 and is further assumed to be located inside a notional polygon 247 formed by the speakers 208 at its vertices. In the arrangement shown in FIG. 2, the convex curve 247 that forms the boundary of the notional convexly-bounded listening region 245 is circular, and a Cartesian coordinate system is assigned having an origin 248 at the center of the circular convex curve 246. The Cartesian coordinate system defines an observation angle θ of each speaker 208 relative to the X-axis 249 of the Cartesian coordinate system. One skilled in the art, now informed by the present disclosure, can apply the teachings of the present disclosure to a notional convexly-bounded planar listening area which is not circular and/or is not entirely within the notional polygon formed by the speakers, or to an outward region of a convex curve, or to a three-dimensional notional convexly-bounded listening region.

Based on the Kirchhoff-Helmholtz integral in wave-field synthesis theory, the problem of configuring the filter coefficients so that the overall frequency response of the speakers as perceived inside the notional convexly-bounded listening region becomes as close as possible to that of a virtual point source can be simplified into synthesizing the idealized transfer function of the virtual point source as well as its directional gradient over the boundary of the notional convexly-bounded listening region. Accordingly the following description will focus on properly synthesizing (i.e. using the speakers to simulate, via a combined speaker transfer function) the idealized transfer function of the virtual point source and its directional gradient over the boundaries of the listening region.

Figure 3:
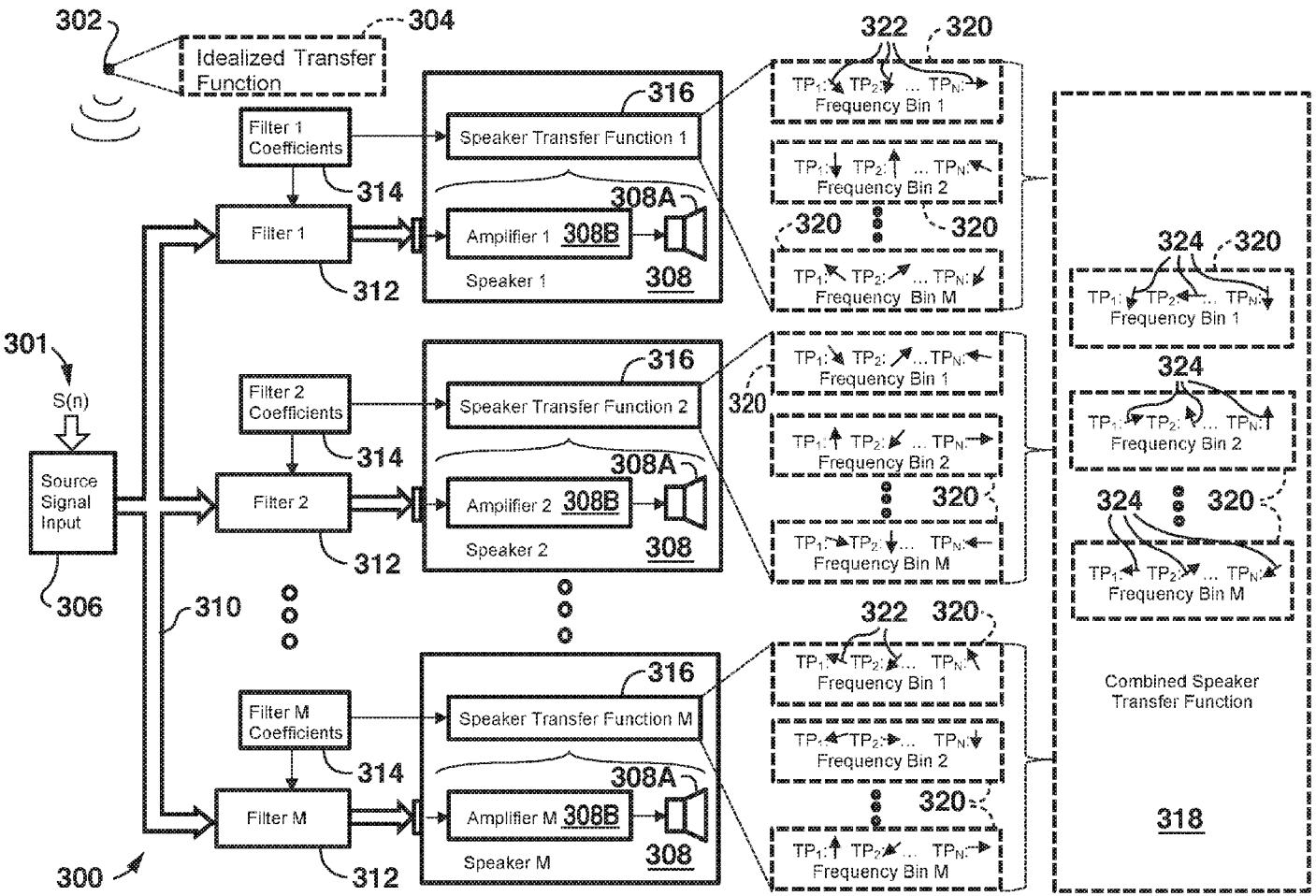
FIG. 3 is a schematic representation of an exemplary generic multi-speaker sound system according to an aspect of the present disclosure.

Reference is now made to FIG. 3, in which an exemplary generic multi-speaker sound system according to the present disclosure is shown schematically and indicated generally by reference numeral 300. The system 300 simulates at least one idealized virtual point source 302 having a respective idealized transfer function 304 (which is a spatial transfer function). The system 300 includes a source signal input 306 adapted to receive a respective audio source signal 301 associated with the idealized virtual point source 302. The source signal is preferably digital, but may be an analog signal that is converted to digital form for processing. The source signal input 306 may be any suitable input, for example a 3.5 mm speaker jack, or a wireless receiver using Wi-Fi or Bluetooth for example, among other types of input. While FIG. 3 shows a single source signal input 306, as noted above the technology described herein may be extended to accommodate a plurality of source signals, in which case the system would incorporate a plurality of source signal inputs, with there being one source signal input associated with each idealized virtual point source. The system 300 further includes a plurality of speakers 308, each of which includes conventional speaker hardware 308A coupled to an amplifier 308B in known manner. The exemplary embodiment in FIG. 3 shows a single source signal input 306 with each speaker 308 having a single physical amplifier 308B; in embodiments which accommodate a plurality of source signals each speaker may have one physical amplifier per signal and the speaker output will be a summation of the amplified signals, as shown in FIG. 1B.

Each of the speakers 308 is coupled to each source signal input (a single source signal input 306 in the exemplary embodiment) by a respective parallel circuit 310 to direct each respective source signal toward each speaker 308. The system further includes a plurality of filters 312, with each filters 312 having a respective filter coefficient set 314. Each of the filters 312 is associated with a single speaker 308 and a single source signal input 306. Thus, in the exemplary system 300 shown in FIG. 3, "Filter 1" 312 is associated with "Speaker 1" 308, "Filter 2" 312 is associated with "Speaker 2" 308, and so on for any arbitrary number "M" of speakers 308 and filters 312. As can be seen in FIG. 3, each filter 312 is interposed between its respective speaker 308 and its respective source signal input 306 to filter the respective source signal. It is also to be appreciated that the filters 312 may inherently perform some amplification. In the embodiment shown in FIG. 3, since there is only a single source signal input 306, each speaker 308 is associated with only a single filter 312; in embodiments which accommodate a plurality of source signals, each speaker will be associated with a plurality of filters (one for each source signal input) even while each filter is associated with a single speaker.

As noted above, each of the filters 312 has a respective filter coefficient set 314. Each speaker 308 has a speaker transfer function 316 for each source signal input 306. Thus, since the embodiment shown in FIG. 3 includes a single source signal input 306, each speaker 308 has a single speaker transfer function; in embodiments which accommodate a plurality of source signals, each speaker will have a plurality of speaker transfer functions. Each speaker transfer function 316 for a particular speaker 308 and a particular source signal input 306 represents that speaker's beam pattern at any arbitrary frequency as a function of the respective filter coefficient set 314 of the filter 308 associated with that particular speaker 308 and that particular source signal input 306. Thus, in the illustrated embodiment, "Speaker Transfer Function 1" 316 represents the beam pattern of "Speaker 1" 308 as a function of the set 314 of "Filter 1 Coefficients", "Speaker Transfer Function 2" 316 represents the beam pattern of "Speaker 2" 308 as a function of the set 314 of "Filter 2 Coefficients", and so on.

The multi-speaker sound system 300 has a combined speaker transfer function 318 for each source signal input 306. In the illustrated embodiment, since there is only a single source signal input 306 there is only a single combined speaker transfer function 318; in embodiments which accommodate a plurality of source signals there will be a plurality of combined speaker transfer functions, i.e. one for each source signal input.

The combined speaker transfer function 318 for a particular source signal input 306 is a summation in space of the speaker transfer functions 316 of the speakers for that source signal input 306 and representing superpositioned speaker transfer functions 316 of the speakers 308 at notional test points within a notional convexly-bounded planar listening region. As used in this context, the term "within" includes notional test points located on the boundary of the convexly-bounded planar listening area. More particularly, each speaker transfer function 316 represents the frequency response at a plurality of notional test points $TP_1$, $TP_2$, . . . $TP_N$ for a plurality of frequency bins 320. For each speaker transfer function 316, the frequency response at a particular test point $TP_1$, $TP_2$, . . . $TP_N$ is a function of the frequency bin 320. At a particular test point $TP_J$, $TP_2$, . . . $TP_N$, the frequency response for a particular frequency bin is a complex value (magnitude and phase) which may be represented as a vector 322. Each combined speaker transfer function 318 also represents the frequency response at a plurality of test points $TP_1$, $TP_2$, . . . $TP_N$ for the plurality of frequency bins 320 but the frequency response at each test point $TP_1$, $TP_2$, . . . $TP_N$ for each frequency bin 320 is a summation of the frequency response for that test point $TP_1$, $TP_2$, . . . $TP_N$ for that frequency bin across all of the speakers 308. For the combined speaker transfer function 318, the frequency response at each test point $TP_1$, $TP_2$, . . . $TP_N$ may also be represented as a vector 324. The speaker transfer functions 316 and the combined speaker transfer function 318 may be continuous functions, so that the frequency response can be calculated at any arbitrary test point, or may be discrete functions which enable calculation of the frequency response at certain predefined test points.

As will be explained in greater detail below, in the exemplary system 300, for each combined speaker transfer function 318, the filter coefficients 314 have respective values that globally minimize in frequency domain, across at least a subset of all frequency bins 320 below a sampling frequency limit, across a frequency-sufficient (as defined below) set of the notional test points $TP_1$, $TP_2$, . . . $TP_N$ having known test point positions relative to notional source positions of the speakers 308, a total difference between that particular combined speaker transfer function 318 and the idealized transfer function 304 of that particular idealized virtual point source 302 at a specified notional position of that idealized virtual point source relative to the notional source positions of the speakers 308. The sampling frequency limit may advantageously be set to the Nyquist frequency, or be lower. Although the sampling frequency limit may in theory be set above the Nyquist frequency, this would not result in any additional frequency bins for which sufficient degrees of freedom are available.

For higher frequency bins, more degrees of freedom are needed. Since the degrees of freedom are dependent on the number of speakers and the number of filter coefficients, in some cases there may not be enough degrees of freedom for the higher frequency bins. Where all of the frequency bins below the sampling frequency limit provide sufficient degrees of freedom, the total difference may be globally minimized across all of the frequency bins. If there is only a subset of the frequency bins below the sampling frequency limit for which there are sufficient degrees of freedom, the total difference may be globally minimized only across only that subset of the frequency bins. Alternatively, for computational efficiency the total difference may be globally minimized only across a subset of the frequency bins which excludes some of the frequency bins for which there are sufficient degrees of freedom.

The term "frequency-sufficient", as used in respect of a set of test points means, with respect to test points for a plurality of frequency bins below a sampling frequency limit, a number of test points that is sufficient to uniquely determine the combined speaker transfer function for each frequency bin, as explained further below. The combined speaker transfer function may encompass all frequency bins below the sampling frequency limit, or only a subset of the frequency bins below the sampling frequency limit (e.g. frequency bins near the limit may provide sufficient degrees of freedom). A set of test points is "frequency-sufficient" if it is sufficient to uniquely determine the combined speaker transfer function for those frequency bins encompassed by the combined speaker transfer function. The "total difference" between a particular combined speaker transfer function and an idealized transfer function of a particular idealized virtual point source, for a given set of test points, is the mathematically evaluated total deviation (a) between the values of the combined speaker transfer function and the values of the idealized transfer function at each test point; and (b) between the directional gradient of the combined speaker transfer function and the directional gradient of the idealized transfer function at each test point. Any suitable mathematical evaluation of the total deviation may be used. For example, calculation of the "total difference" between a particular combined speaker transfer function and the idealized transfer function of a particular idealized virtual point source at a specified notional position of that idealized virtual point source relative to the notional source positions of the speakers 308 may be carried out using equation 1.18 if the test points are on the boundary of the notional convexly-bounded listening region, as described further below. In this case, minimizing the total difference means minimizing both the difference between the spatial transfer functions (the left side of equation 1.18) and the difference between the directional gradients of the spatial transfer functions (the right side of equation 1.18) using the min-squared method. Using equation 1.18, the test points may all be inside the notional convexly-bounded listening region, or all of the test points $TP_1$, $TP_2$, . . . $TP_N$ are on the boundary of the notional convexly-bounded listening region. If all of the test points $TP_1$, $TP_2$, . . . $TP_N$ are inside the notional convexly-bounded listening region (i.e. none of the test points TP1, TP2, . . . TPN are on the boundary of the notional convexly-bounded listening region), minimization of the differences between the directional gradients will happen automatically (i.e. the right side of equation 1.18 becomes zero). However, if all of the test points $TP_1$, $TP_2$, . . . $TP_N$ are on the boundary of the notional convexly-bounded listening region and the speaker transfer function is discrete rather than continuous then the directional gradients at the test points $TP_1$, $TP_2$, . . . $TP_N$ must be calculated. Equation 1.18 is merely one exemplary equation for calculating, for a given set of test points, the total difference between a particular combined speaker transfer function and an idealized transfer function of a particular idealized virtual point source, for a given set of test points. Equation 1.18 is an advantageous way to calculate the total difference because it can be solved as a convex optimization problem; other techniques for calculating the total difference may also be used.

Figure 3A:
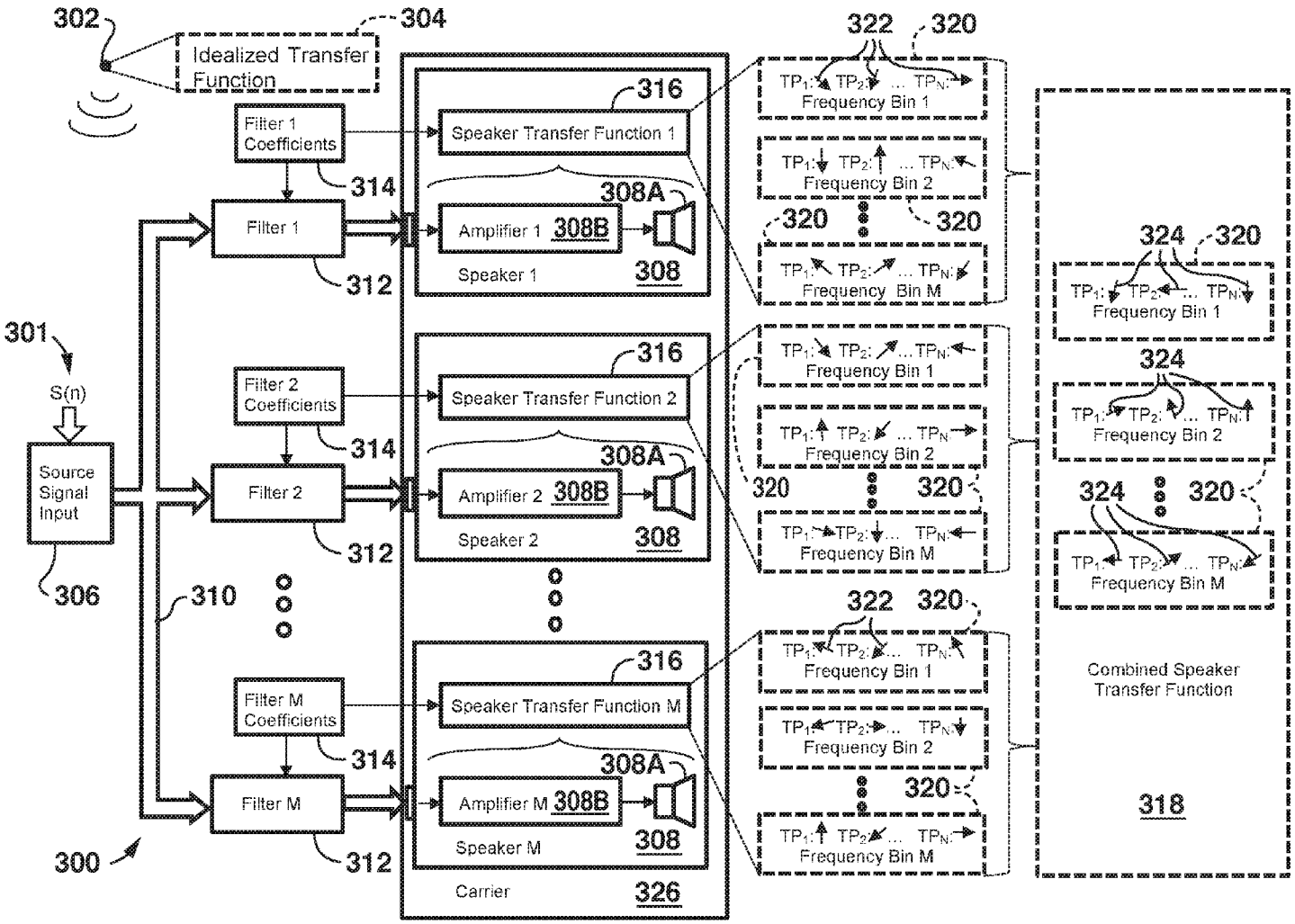
FIG. 3A shows a first embodiment of the sound system of FIG. 3 in which the speakers are secured to a carrier with fixed spatial positions relative to one another and an idealized virtual point source has a fixed position relative to the speakers.

Reference is now made to FIG. 3A, which shows a particular embodiment of the system 300 in which the speakers 308 are secured to a carrier 326 with fixed spatial positions relative to one another. The carrier 326 may, for example, be a generally planar base, or a common housing, or may take any other suitable form. Alternatively, the carrier may be one or more elements of a structure which encompasses a notional convexly-bounded listening region, such as the walls of a room or the passenger compartment of a motor vehicle. In embodiment shown in FIG. 3A not only do the speakers 308 have fixed spatial positions relative to one another, but each idealized virtual point source 302 (in the illustrated embodiment, a single idealized virtual point source 302) also has a predefined fixed position relative to the positions of the speakers 308. Since the relative positions of the idealized virtual point source(s) 302 and the speakers 308 are known, the values of the filter coefficients 314 that globally minimize the total difference between the combined speaker transfer function 318 and the idealized transfer function 304 can be calculated in advance, and the filters 312 are preconfigured with these precalculated filter coefficients 314.

Figure 3B:
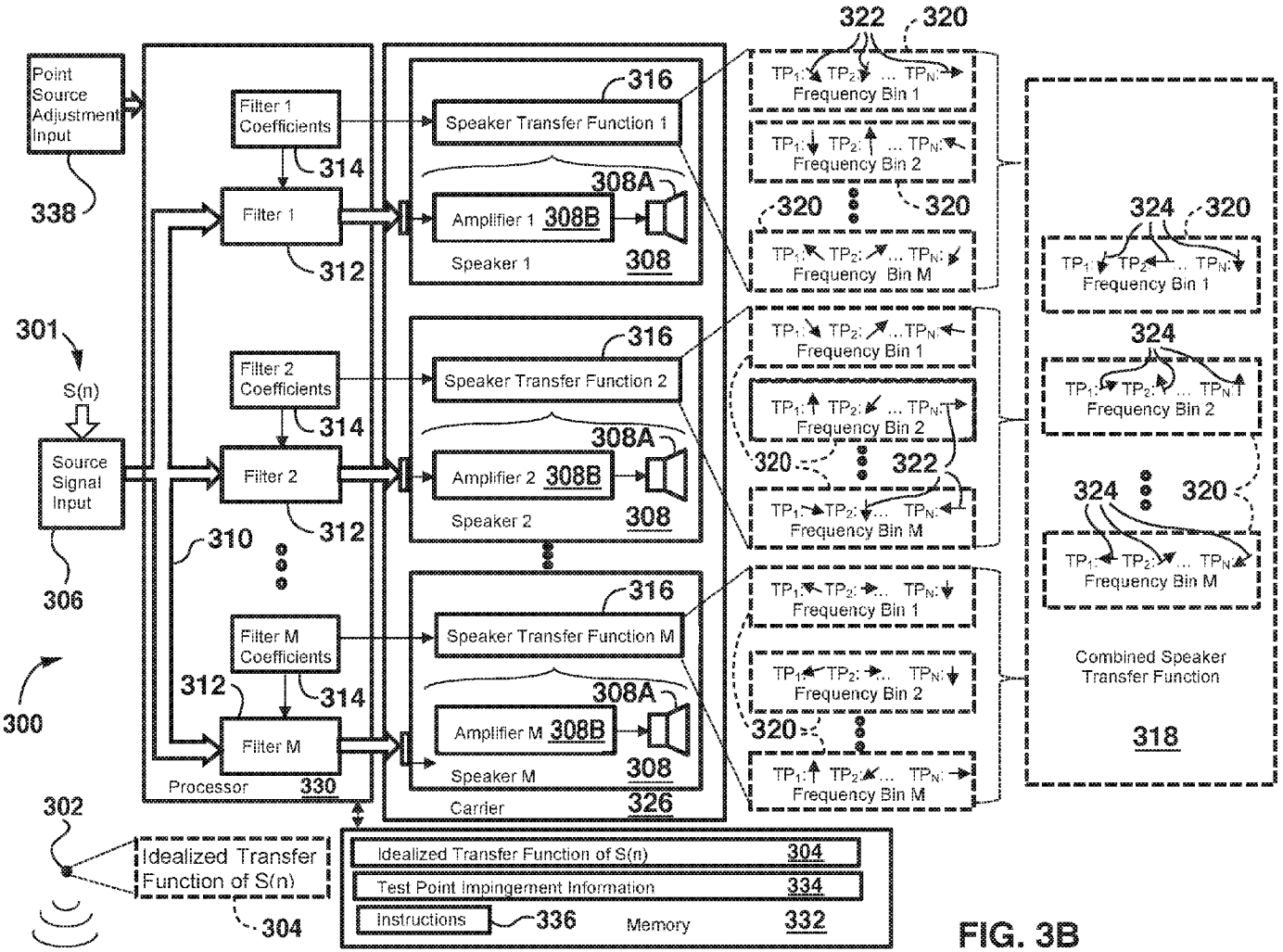
FIG. 3B shows a second embodiment of the sound system of FIG. 3 in which the speakers are secured to a carrier with fixed spatial positions relative to one another and an idealized virtual point source has a variable position relative to the speakers.

Reference is now made to FIG. 3B, which shows another particular embodiment of the system 300 in which the speakers 308 are secured to a carrier 326 with fixed spatial positions relative to one another. In the embodiment shown in FIG. 3B, each idealized virtual point source 302 (in the illustrated embodiment, a single idealized virtual point source 302) has a variable (i.e. user-adjustable) position relative to the positions of the speakers 308. The embodiment of the system 300 shown in FIG. 3B further includes at least one processor 330 (in this case a single processor 330) and at least one memory 332 coupled to the processor 330. The processor 330 is coupled to the filters 312 so as to be able to configure the filters 312 to have specified filter coefficient values 314. In the exemplary embodiment shown in FIG. 3B, the filters 312 are software filters which are implemented in the processor 330 and the processor 330 is thereby inherently coupled to the filters 312. In other embodiments, the filters may be, or be implemented in, one or more separate components to which the processor is coupled.

The memory 332 stores test point impingement information 334, the idealized transfer function 304 of each idealized virtual point source 302 (in the illustrated embodiment, a single idealized transfer function 304 for a single idealized virtual point source 302), and instructions 336 for execution by the processor 330.

The test point impingement information 334 represents, across at least a subset of all frequency bins 320 below the sampling frequency limit, at least for each test point in the frequency-sufficient set of the notional test points $TP_1$, $TP_2$, . . . $TP_N$, combined speaker transfer function values at the test points $TP_1$, $TP_2$, . . . $TP_N$ and combined speaker transfer function gradient vector values at the test points $TP_1$, $TP_2$, . . . $TP_N$. The test point impingement information 334 may take a variety of forms, using pre-calculation or dynamic calculation depending on the particular implementation.

In an implementation using dynamic calculation, the test point impingement information 334 includes at least one of (a) at least the inherent transfer function components of the speaker transfer functions 316 (the filter-dependent components of the speaker transfer functions 316 are not needed for this calculation) and (b) the combined speaker transfer function 318 (the speaker transfer functions 316 can be used to generate the combined speaker transfer function 318 if the combined speaker transfer function 318 is not part of the test point impingement information 334). In such an implementation, the test point impingement information 334 represents the values of the combined speaker transfer function 318 at the test points $TP_1$, $TP_2$, . . . $TP_N$ by enabling calculation of the values of the combined speaker transfer function 318 at any arbitrary group of test points across the entire notional convexly-bounded listening region (which in this case is planar). In such an embodiment, where the test point impingement information includes the combined speaker transfer function 318, the test point impingement information represents the combined speaker transfer function gradient vector values at the test points $TP_1$, $TP_2$, . . . $TP_N$ by enabling calculation of the combined speaker transfer function gradient values at the test points for any arbitrary group of test points across the entire notional convexly-bounded listening region.

In an implementation using pre-calculation, the test points $TP_1$, $TP_2$, . . . $TP_N$ are pre-defined test points, and the test point impingement information 334 represents the combined speaker transfer function values at the test points $TP_1$, $TP_2$, . . . $TP_N$ using pre-calculated test point transfer functions for each test point $TP_1$, $TP_2$, . . . $TP_N$ and represents the combined speaker transfer function gradient vector values at the test points $TP_1$, $TP_2$, . . . $TP_N$ using pre-calculated test point transfer function gradient vectors for each test point.

As noted above, in the embodiment shown in FIG. 3B, the idealized virtual point source 302 has a variable (i.e. user-adjustable) position relative to the positions of the speakers 308. To this end, a corresponding point source adjustment input 338 is coupled to the processor 330; the point source adjustment input 338 is adapted to provide the specified notional position of the idealized virtual point source 302 to the processor 330. In the exemplary embodiment shown in FIG. 3B there is a single idealized virtual point source 302 and hence a single point source adjustment input 338; in embodiments which accommodate a plurality of source signals there will be a plurality of point source adjustment inputs each adapted to provide the specified notional position of a respective idealized virtual point source to the processor. The point source adjustment input may include, for example, one or more knobs or buttons or a touch screen display or portion thereof.

The instructions 336 stored by the memory 332, when executed by the processor 330, cause the processor 330 to implement a number of steps. The instructions 336 cause the processor 330 to receive, from the point source adjustment input 338, the specified notional position of the idealized virtual point source 302 and evaluate the idealized transfer function 304 of the idealized virtual point source 302 for the specified notional position of that idealized virtual point source 302. The instructions 336 further cause the processor 330 to determine, for each source signal input 306 (a single source signal input in the illustrated embodiment), a set 314 of filter coefficient values that minimize the total difference between the combined speaker transfer function 316 and the idealized transfer function 304. More particular, the processor will execute the instructions to globally minimize in frequency domain, across at least a subset of all frequency bins 320 below a sampling frequency limit, across the frequency-sufficient set of the notional test points $TP_1$, $TP_2$, . . . $TP_N$, the total difference between the combined speaker transfer function 316 and the idealized transfer function 304 of the idealized virtual point source 302 associated with that particular source signal input 306 at the specified notional position of that idealized virtual point source 302. After making the foregoing determination, the processor 330 further executes the instructions 336 to configure the filters 312 to have a filter coefficient set 314 corresponding to the determined coefficient values.

Figure 4:
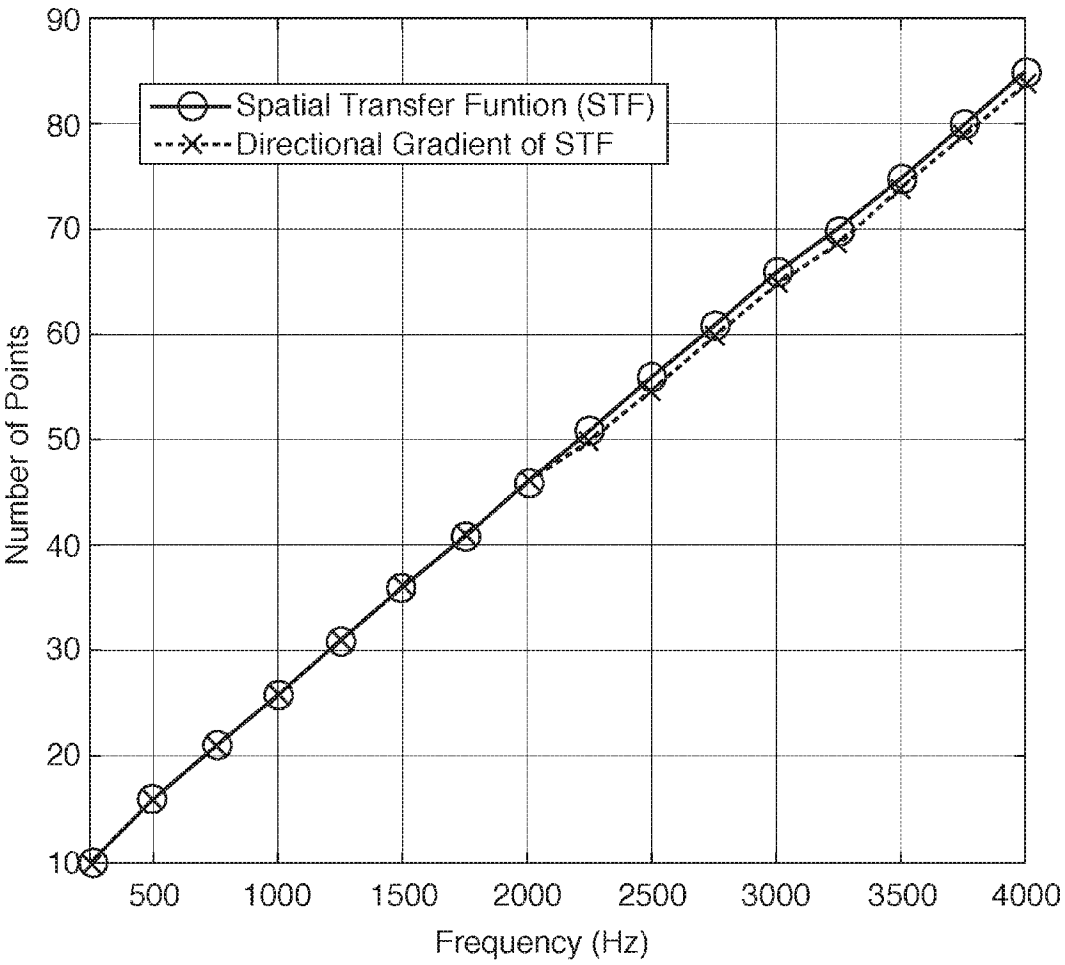
FIG. 4 is a graph illustrating the required number of discrete points for the unique identification of the spatial transfer function $h_{plane}(\theta,f_l)$ (or accordingly any arbitrary spatial transfer function $k(x,f_l)$) for the fixed frequency bin $f_l$ over a circular planar listening region with radius one.
Figure 5:
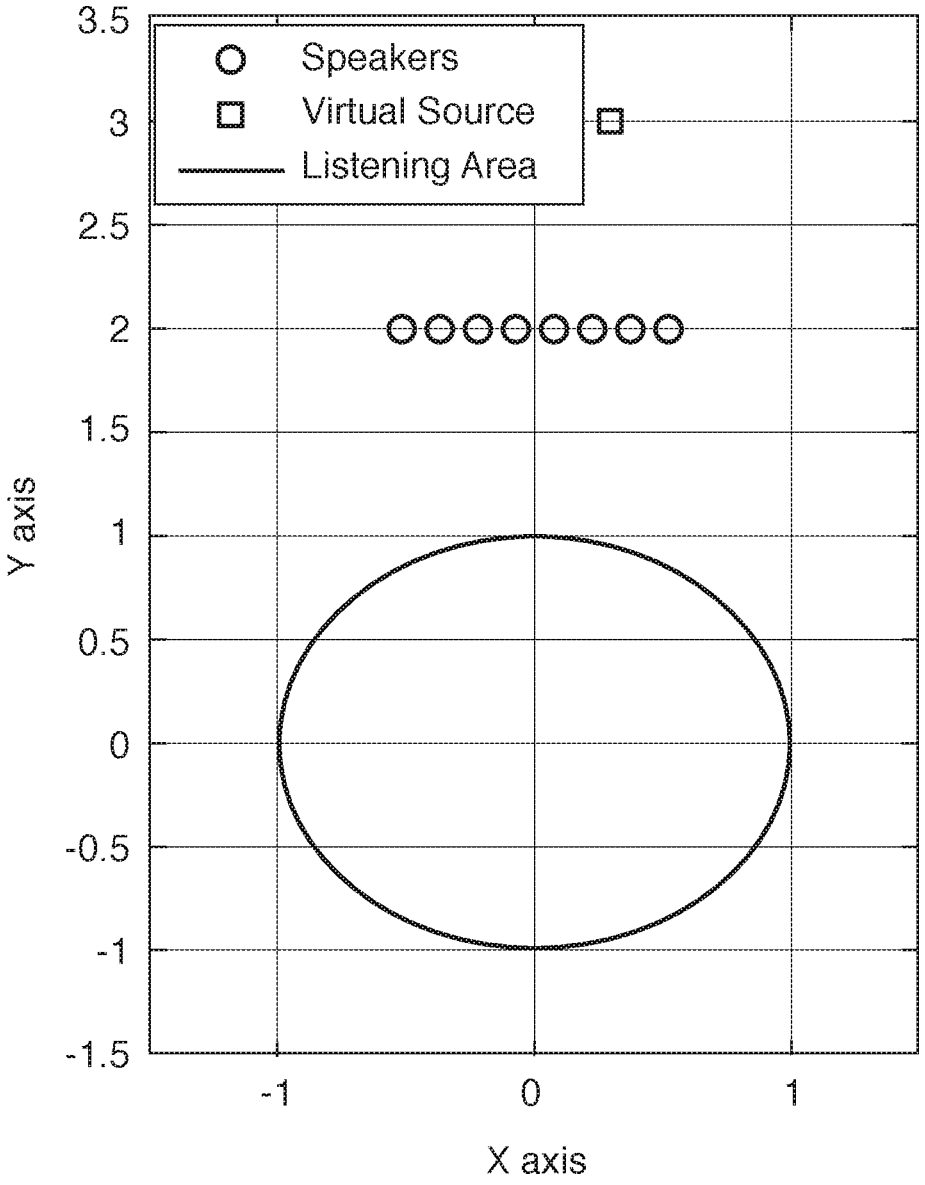
FIG. 5 shows the configuration of speakers, virtual point source, and preferred desired listening region for an exemplary numerical evaluation of methods according to the present disclosure.
Figure 6:
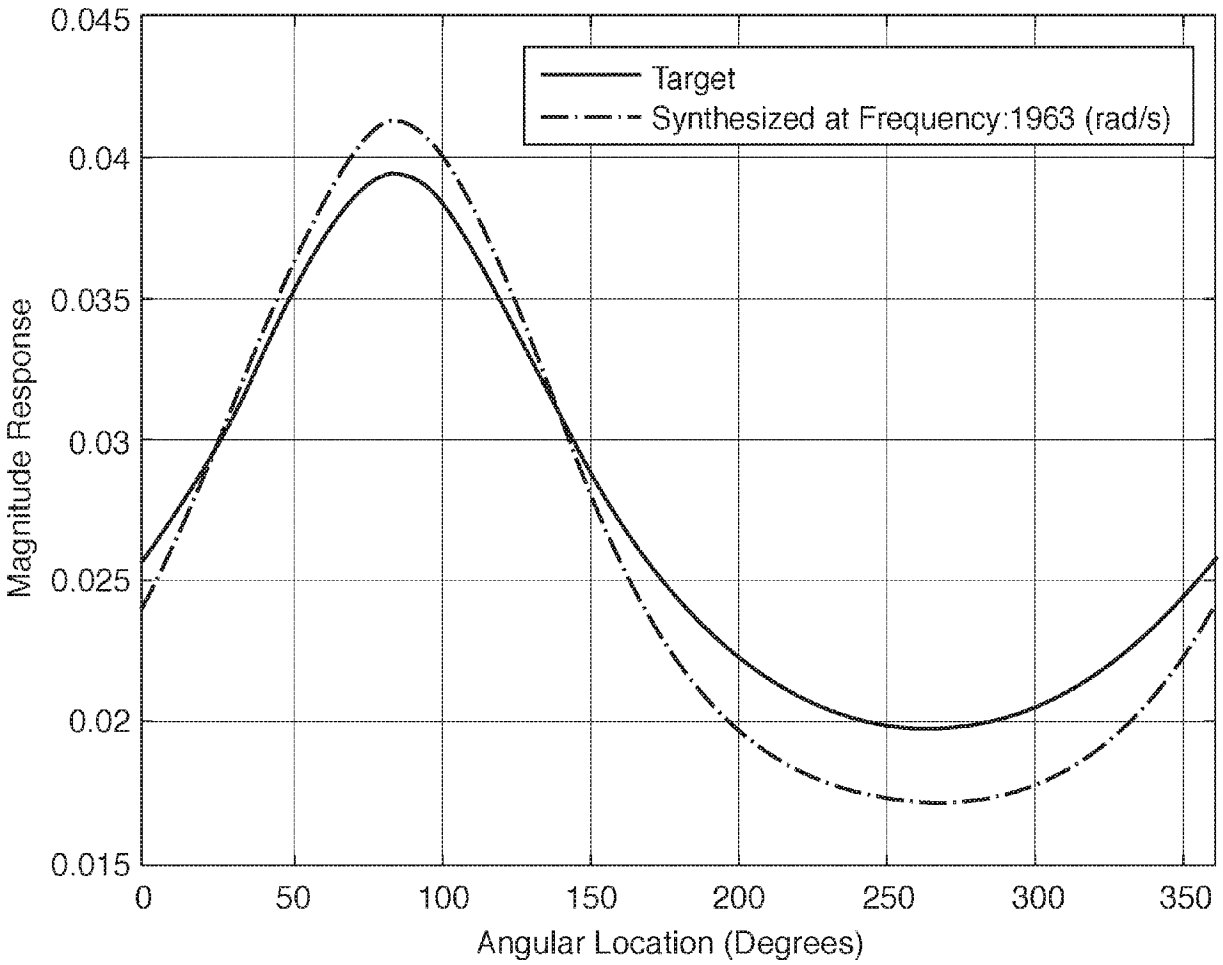
FIGS. 6 to 11, respectively, show magnitude and phase responses of the synthesized combined speaker transfer function and the idealized transfer function of the virtual point source over the boundary of the listening region in FIG. 5 across three different frequencies, namely, 1963 rad/s, 4909 rad/s, and 7854 rad/s.

In the exemplary embodiments of the system 300 shown in FIGS. 4 to 6 and described above, each of the speakers 308 is assumed to have a known spatial location relative to the other speakers, that is, each speaker i is assumed to be located at location $x_i$.

Reference is now made to FIG. 3C, which shows an exemplary embodiment of the system 300 in which the idealized virtual point source 302 has a variable (i.e. user-adjustable) position relative to the positions of the speakers 308, and in which the positions of the speakers 308 are not known a priori and only their associated spatial frequency responses (and accordingly their corresponding directional gradients) are known. The embodiment of the system 300 shown in FIG. 3C includes a speaker localization system 340 coupled to the processor 330. The speaker localization system 340 is adapted to determine the notional source positions of the speakers 308 and provide the notional source positions of the speakers 308 to the processor 330. For example, the speaker localization system 340 may utilize the "active bat" localization technology. In an "active bat" embodiment, transmitters 342 on each speaker 308 would emit short pulses of ultrasound which are detected by an array of receivers 344 located at known positions on the ceiling of the room in which the speakers 308 are located. Since the speed of sound in air is known, so the distances to the receivers can be calculated and with three or more such distances the positions of the speakers 308 can be determined using trilateration. The "active bat" technology is further described in Addlesee et al., *Implementing a Sentient Computing System*, IEEE Computer Magazine, Vol. 34, No. 8, August 2001, pp. 50-56. The speaker localization system 340 may include a separate computing device which communicates with the processor 330 and/or may be implemented in whole or in part by software instructions executing within the processor 330.

As in the embodiment shown in FIG. 3B, in the embodiment of the system 300 shown in FIG. 3C a processor 330 is coupled to the filters 312, and a memory 332 and a point source adjustment input 338 are coupled to the processor 330. In the embodiment shown in FIG. 3C, the memory 332 stores the speaker transfer functions 316 for the speakers 308, the idealized transfer function 304 of each idealized virtual point source 302, and instructions 336 for execution by the processor 330.

The instructions 336, when executed by the processor 330, cause the processor 330 to receive the notional source positions of the speakers 308 from the speaker localization system 340 and determine the combined speaker transfer function 318 for each source signal input 306 (in this case a single source signal input 306) from the notional source positions of the speakers 308. In particular, because the memory 332 stores the speaker transfer functions 316 for the speakers 308, the processor 330 can use the speaker transfer functions 316 and the notional source positions of the speakers 308 from the speaker localization system 340 to determine the combined speaker transfer function(s) 318. The instructions 336 further cause the processor 330 to receive, from the point source adjustment input 338, the specified notional position of the idealized virtual point source 302 and evaluate the idealized transfer function 304 of the idealized virtual point source 302 for the specified notional position of that idealized virtual point source 302.

The instructions 336 further cause the processor 330 to determine, for each source signal input 306 (a single source signal input 306 in the illustrated embodiment), a set 314 of filter coefficient values that minimize the total difference between the combined speaker transfer function 316 and the idealized transfer function 304. Thus, the instructions cause the processor to perform calculations that globally minimize in frequency domain, across at least a subset of all frequency bins 320 below a sampling frequency limit, across the frequency-sufficient set of the notional test points $TP_1$, $TP_2$, . . . $TP_N$, the total difference between the combined speaker transfer function 316 and the idealized transfer function 304 of the idealized virtual point source 302 associated with that particular source signal input 306 at the specified notional position of that idealized virtual point source 302. After making the foregoing determination, the processor 330 further executes the instructions 336 to configure the filters 312 to have a filter coefficient set 314 corresponding to the determined coefficient values.

In the above apparatus, each speaker 308 has a speaker transfer function 316 for each source signal 301, and each speaker transfer function 316 for a particular speaker 308 and a particular source signal 301 represents that speaker's beam pattern as a function of the respective filter coefficient set 314 of the filter 312 associated with that particular speaker 308 and that particular source signal 301. Detailed mathematical approaches to minimizing the total difference between the combined speaker transfer function 316 and the idealized transfer function 304 will now be described.

For each speaker, its corresponding spatial frequency response and the directional gradient of its spatial frequency response is assumed to be known a priori on each point (or at least on a sufficient number of points) over the convex boundary of the notional listening region (FIG. 2), or may be determined using suitable methodology (e.g. positioning microphones at the test points and transmitting test signals from the speakers).

Each filter has a respective filter coefficient set. The FIR filter coefficients of the $i^{th}$ speaker are denoted as $F_{i,k}$, k=1, 2, 3, . . . , N where N denotes the filter length. Furthermore, the sampling frequency of the input digital audio (including analog audio converted to digital, e.g. by the processor 330) is assumed to be equal to $f_s$. The FIR filters will be configured in such a way that the combined speaker transfer function of the speakers and its associated directional gradient is as close as possible to that of the virtual point source over $N_{Freq}$ (sufficiently large) uniformly spaced points in the frequency interval of [0, $f_d$] where $$f_d \le \frac{f_s}{2}$$

and $f_d$ stands for the desired upper-frequency while $f_s$ stands for the sampling frequency of audio signal and $f_s/2$ denotes the Nyquist frequency. In other words, for each combined speaker transfer function, the filter coefficients have respective values that globally minimize in frequency domain, across at least a subset of all frequency bins below a sampling frequency limit, across a frequency-sufficient set of the notional test points having known test point positions relative to notional source positions of the speakers, a total difference between that particular combined speaker transfer function and an idealized transfer function of that particular idealized virtual point source at a specified notional position of that idealized virtual point source relative to the notional source positions of the speakers.

The combined frequency response of the speakers at a location x in the space at frequency bin $$f_l = \frac{f_d}{(N_{Freq}-1)} l,$$

l=0, 1, 2, . . . , $N_{Freq}-1$ (i.e. the combined speaker transfer function, which is a spatial transfer function) can be expressed as $$h(x, f_l) = \sum_{i=1}^{M} Q_i(x - x_i, f_l) \cdot \left( \sum_{k=1}^{N} F_{i,k} e^{-j\frac{2\pi f_l}{f_s}(k-1)} \right) \tag{1.1}$$

where M stands for the number of speakers and $Q_i(y,f)$ denotes the spatial frequency response (speaker transfer function) of $i^{th}$ speaker at the location y (assuming that speaker is located at the origin of the Cartesian coordinate system) and frequency f. Thus, a multi-speaker sound system according to the present disclosure has a combined speaker transfer function for each source signal, with each combined speaker transfer function for a particular source signal being a summation in space of the speaker transfer functions of the speakers for that source signal input and representing superpositioned speaker transfer functions of the speakers at notional test points within a notional convexly-bounded planar listening area. As noted above, the term "within" includes notional test points located on the boundary of the convexly-bounded planar listening area. Notional source positions of the speakers may be used to determine the combined speaker transfer function for each source signal.

The directional gradient of the combined transfer function can be obtained as $$\frac{\partial h(x, f_l)}{\partial n} = \sum_{l=1}^{M} \frac{\partial Q_i(x - x_i, f_l)}{\partial n} \cdot \left( \sum_{k=1}^{N} F_{i,k} e^{-j\frac{2\pi f_l}{f_s}(k-1)} \right) \tag{1.2}$$

The abbreviation $$\frac{\partial}{\partial n}$$

denotes the directional gradient in the direction of n where n is an inward unitary vector which is the perpendicular to the boundary of the listening region at x. The so-obtained combined speaker transfer function as well as its directional gradient can be further expressed in the following compact forms, respectively, $$h(x, f_l) = a^T(x, f_l) F b(f_l) \tag{1.3}$$

$$\frac{\partial h(x, f_l)}{\partial n} = a_n^T(x, f_l) F b(f_l) \tag{1.4}$$

in which $a(x,f_l)$, $a_n(x,f_l)$, and $b(f_l)$ are columns vectors defined, respectively, as $$[a(x, f_l)]_i \triangleq Q_i(x - x_i, f_l),\ i = 1, 2, 3, \ldots, M, \tag{1.5}$$

$$[a(x, f_l)]_i \triangleq \frac{\partial Q_l(x - x_i, f_l)}{\partial n},\ i = 1, 2, 3, \ldots, M, \tag{1.6}$$

and $$[b(f_l)]_k \triangleq e^{-j\frac{2\pi f_l}{f_s}(k-1)},\ k = 1, 2, 3, \ldots, N \tag{1.7}$$

and $(.)^T$ denotes the matrix transpose operator. Moreover, F is a M×N matrix where $[F]_{i,k}=F_{i,k}$ where $F_{i,k}$ denotes the $k^{th}$ coefficient of $i^{th}$ FIR filter (i.e. each filter has a respective filter coefficient set). Combined speaker transfer function (1.3) as well its directional gradient (1.4) can be simplified by using the following equality:

$$vec(A \cdot B \cdot C) = (C^T \otimes A)vec(B) \tag{1.8}$$

where vec (·) stands for the vectorization operation that transforms a matrix into a long vector stacking the columns of the matrix one after another and ⊗ denotes the Kronecker product. By utilizing the equality (1.8), the combined speaker transfer function and its directional gradient can be equivalently expressed as $$\begin{aligned} h(x, f_l) &= a^T(x, f_l)Fb(f_l) \\ &= (b^T(f_l) \otimes a^T(x, f_l)) \cdot vec(F) \\ &= (b^T(f_l) \otimes a^T(x, f_l))f, \end{aligned} \tag{1.9}$$

and $$\begin{aligned} \frac{\partial h(x, f_l)}{\partial n} &= a_n^T(x, f_l)Fb(f_l) \\ &= (b^T(f_l) \otimes a_n^T(x, f_l)) \cdot f \end{aligned} \tag{1.10}$$

in which the vector $f \triangleq vec(F)$. As noted above the FIR filters, i.e., matrix F or equivalently vector f, are configured in such a way that the combined spatial function and its corresponding directional gradient becomes as close as possible to that of a virtual point source over the boundaries of listening region on $N_{Freq}$ frequency bins. As a result, for each combined speaker transfer function, the filter coefficients have respective values that globally minimize in frequency domain, across at least a subset of all frequency bins below a sampling frequency limit, across a frequency-sufficient set of the notional test points having known test point positions relative to notional source positions of the speakers, a total difference between that particular combined speaker transfer function and an idealized transfer function of that particular idealized virtual point source at a specified notional position of that idealized virtual point source relative to the notional source positions of the speakers.

As noted above, the term "frequency-sufficient", as used in respect of a set of test points means, with respect to test points for a plurality of frequency bins below a sampling frequency limit, a number of test points that is sufficient to uniquely determine the combined speaker transfer function for each frequency bin. At an arbitrary frequency bin denoted as fi, the idealized transfer function of a virtual point source (or its directional gradient) can be precisely synthesized if the combined speaker transfer function (or its directional gradient) is equal to that of the virtual point source at a discrete number of points due to the sampling theorem. This is explained in more detail for a circular planar listening area, however, the following description is also applicable for an arbitrary convex listening curve. Thus, it is to be understood that a circular planar listening area is a particular case of a convexly-bounded listening region, which may be two-dimensional or three dimensional.

It can be shown that at any specific frequency bin, the idealized transfer function (which is a spatial transfer function) of a virtual point source or the combined speaker transfer function (also a spatial transfer function) of a set of speakers can be uniquely described (identified) if they are known over some distinct discrete points over the boundaries of the listening region. An arbitrary spatial transfer function (corresponding to an arbitrary audio source) denoted as $k(x,f_l)$ can be expressed as the summation of spatial transfer functions of an infinite number of plane waves as:

$$k(x, f_l) = \int_{-\pi}^{\pi} c(\alpha) e^{-j\frac{2\pi f_l}{c}(x\cos(\alpha) + y\sin(\alpha))} d\alpha \tag{1.11}$$

where x=(x,y) and c(α) denotes the complex amplitude associated with a plane wave with the incidence angle of α. Assuming that the origin of the Cartesian coordinate is located at the center of the circular planar listening area, the spatial transfer function (1.11) can be equivalently expressed as $$\begin{aligned} k(\theta, f_l) &= \int_{-\pi}^{\pi} c(\alpha) e^{-j\frac{2\pi f_l}{c}R(\cos(\theta)\cos(\alpha) + \sin(\theta)\sin(\alpha))} d\alpha \\ &= \int_{-\pi}^{\pi} c(\alpha) e^{-j\frac{2\pi f_l}{c}R\cos(\theta - \alpha)} d\alpha \end{aligned} \tag{1.12}$$

where θ denotes the observation angle (as illustrated in FIG. 2) and R stands for the radius of the circular planar listening area. For a plane wave with the incidence angle α, the corresponding spatial transfer function is band-limited over the circular planar listening area. Due to the symmetry of a circular planar listening area, the band-width of a plane wave with an arbitrary incidence angle will be equal to that of a plane wave with incidence angle equal to zero, i.e., α=0. The spatial transfer function of such a plane wave with the incidence angle of α=0 over the boundaries of a circular planar listening area with radius R can then be expressed as $$h_{plane}(\theta, f_l) = e^{-j\frac{2\pi f_l}{c}R\cos(\theta)} \tag{1.13}$$

For a fixed $f_l$, the spatial transfer function $h_{plane}(\theta, f_l)$ is periodic with a period of 2π. Accordingly, using Fourier series, it can be expanded as $$h_{plane}(\theta, f_l) = e^{-j\frac{2\pi f_l}{c}R\cos(\theta)} = \sum_{l=-\infty}^{\infty} c_l e^{jl\theta} \tag{1.14}$$

For the large values of l the corresponding Fourier series coefficient, i.e., $c_l$, is sufficiently small which allows to approximate equation (1.14) as $$h_{plane}(\theta, f_l) = e^{-j\frac{w_l}{c}R\cos(\theta)} \approx \sum_{l=-N}^{N} c_l e^{jl\theta} \tag{1.15}$$

Since $h_{plane}(\theta,f_l)$ can be approximated as the summation of 2N+1 exponential functions, according to the sampling theorem, 2N+1 distinct points on the boundaries of the circular planar listening area are sufficient to uniquely identify the spatial transfer function $h_{plane}(\theta,f_l)$ in (1.15). In other words, there is a one-to-one correspondence between $h_{plane}(\theta,f_l)$, $0\leq\theta\leq 2\pi$ in (1.15) and $h_{plane}(\theta_i,f_l)$, i=1, 2, . . . , 2N+1 where $\theta_i$, i=1, 2, . . . , 2N+1 denotes a set of distinct points over the boundaries of the circular listening area. Based on this observation, at frequency bin $f_l$, the spatial transfer function of the virtual point source, that is, the idealized transfer function of the virtual point source, can be precisely synthesized over the boundaries of the circular listening area if the value of the combined speaker transfer function is equal to the value of the idealized transfer function of the virtual point source over 2N+1 distinct discrete points over the circular boundary of the planar listening area.

FIG. 4 illustrates the required number of discrete points for the unique identification of the spatial transfer function $h_{plane}(\theta, f_l)$ (or accordingly any arbitrary spatial transfer function $k(x,f_l)$) for the fixed frequency bin $f_l$ over a circular planar listening area with radius one. As can be observed from FIG. 4, the required number of test points grows linearly with frequency. In a similar way, the directional gradient of the combined speaker transfer function at the observation point θ over the circular planar listening area can be expressed as $$\frac{\partial k(x, f_l)}{\partial n} = \frac{2\pi f_l}{c}\int_{-\pi}^{\pi} c(\alpha)\cos(\theta-\alpha)e^{-j\frac{2\pi f_l}{c}R\cos(\theta-\alpha)}\,d\alpha \tag{1.16}$$

Based on a similar argument, the directional gradient of any arbitrary source on a planar circular listening area with a fixed radius can be uniquely identified using a fixed number of distinct points over the listening area, as shown in FIG. 4.

Thus, the term "frequency-sufficient" means, with respect to test points for a plurality of frequency bins below a sampling frequency limit, a number of test points that is sufficient to uniquely determine the combined speaker transfer function for each frequency bin. Because this number will increase with frequency as shown in FIG. 4, the largest number (i.e. that for the highest frequency bin below the sampling frequency limit) will be "frequency-sufficient" and may be used for all frequency bins; alternatively different numbers of test points may be used for each frequency bin; this is also considered to be "frequency sufficient" so long as it enables unique determination of the combined speaker transfer function for each frequency bin).

Note that for the more general case of a planar listening area with a convex boundary, the same arguments hold valid. More specifically in this case, the distance between the origin of the Cartesian coordinate system and a point on the boundaries of the planar listening area with the observation angle of θ is angle dependent and can be denoted as R(θ) (without loss of generality, it is assumed that the origin of the Cartesian coordinate system lies inside the arbitrary convex planar listening area). In this case, the arbitrary spatial transfer function in (1.12) can be expressed as $$k(\theta, f_l) = \int_{-\pi}^{\pi} c(\alpha)e^{-j\frac{2\pi f_l}{c}R(\theta)\cos(\theta-\alpha)}\,d\alpha \tag{1.17}$$

For each incidence angle $\alpha\epsilon[0,2\pi]$, the function $$e^{-j\frac{2\pi f_l}{c}R(\theta)(\cos(\theta-\alpha))}$$

is periodic with 2π and similar arguments hold. The only difference is that the necessary number of points is equal to the maximum of the necessary number of points for each angle of incidence. Note that for the particular case in which the listening area is half a plane, the minimum necessary spatial sampling frequency over the dividing line is equal to $$\frac{2f_l}{c}$$

where $f_l$ denotes the frequency bin and c stands for the audio speed. Moreover, in this case, based on the Rayleigh integrals, only the idealized transfer function of the virtual point source needs to be synthesized over the boundary in order to synthesize it in the entire listening area.

For the case of a three-dimensional notional convexly-bounded listening region, the number of test points will be considerably larger than in the two-dimensional case (i.e. planar listening area). While calculation of appropriate test points for a three-dimensional notional convexly-bounded listening region is contemplated, alternatively a sufficiently dense randomly selected sample of points within the notional convexly-bounded listening region may be used as test points (as in the two-dimensional case, for a three-dimensional notional convexly-bounded listening region the test points may all be inside the boundary, or may all be on the boundary).

Based on the latter discussion, configuring the FIR filters, i.e., matrix F or equivalently vector f, to minimize the difference between a combined speaker transfer function and its corresponding directional gradient and the idealized transfer function of a virtual point source and its corresponding directional gradient over the boundaries of a planar listening area over $N_{Freq}$ frequency bins (i.e. minimizing the total difference between that particular combined speaker transfer function and an idealized transfer function of that particular idealized virtual point source at a specified notional position of that idealized virtual point source relative to the notional source positions of the speakers) can be expressed as the following optimization problem $$\min_f \sum_{f_l} \alpha_{f_l}\left(\sum_{x_k(f_l)} |h(x_k(f_l), f_l) - g(x_k(f_l), f_l)|^2 + \sum_{x_m(f_l)}\left|\frac{\partial h(x_m, f_l)}{\partial n} - \frac{\partial g(x_m, f_l)}{\partial n}\right|^2\right) \tag{1.18}$$

where the sampling points on the inner summations depends on the frequency $f_l$ and they are selected as distinct points which can uniquely identify an arbitrary spatial transfer function or its gradient over the listening area. In the optimization problem (1.18), $h(x_k(f_l),f_l)$ and $\partial h(x_m,f_l)/\partial n$ denote, respectively, the combined speaker transfer function and the directional gradient of the combined speaker function while $g(x_k(f_l),f_l)$ and $\partial g(x_m,f_l)/\partial n$ stands for the idealized transfer function of the virtual point source and its directional gradient, respectively.

In the optimization problem (1.18), the summation on the left represents the difference between the combined speaker transfer function and the idealized transfer function of the virtual point source at the test points, and the summation on the right represents the difference between the directional gradient of the combined speaker transfer function and the directional gradient of the idealized transfer function of the virtual point source at the test points. Using equation 1.18, the test points may all be inside the convex boundary of the planar listening area, or all of the test points may be on the convex boundary of the planar listening area. If all of the test points are located interiorly of the convex boundary of the planar listening area, the summation on the right (the difference between the directional gradient of the combined speaker transfer function and the directional gradient of the idealized transfer function of the virtual point source at the test points) becomes zero. However, if all of the test points are on the convex boundary of the planar listening area the idealized transfer function of the virtual point source can be synthesized accurately inside the listening area, if in addition to the idealized transfer function, its directional gradient is also synthesized on the boundary.

It is also possible to first identify the minimum required number of points for the highest frequency bin and use the same points for the lower frequency bins as well; in other words, oversample the listening area boundaries for lower-frequency bins. In equation above $\alpha_{f_l}$ denotes the weight assigned to different frequency bins. Higher weights can be assigned to the frequencies which are of higher importance.

In both cases (different points for different frequency bins or oversampling), by substituting the combined speaker transfer function and its directional gradient as functions of the design parameters, the design optimization problem can be expressed as $$\min_f \sum_{f_l} \alpha_{f_l}\left(\sum_{x_k(f_l)} |(b^T(f_l)\otimes a^T(x_k(f_l),f_l))f - g(x_k(f_l),f_l)|^2 + \sum_{x_m(f_l)} \left|b^T(f_l)\otimes a_n^T(x,f_l))f - \frac{\partial g(x_m,f_l)}{\partial n}\right|^2\right) \tag{1.19}$$

or equivalently as $$\min_f \sum_{f_l} \alpha_{f_l}\left(\sum_{x_k(f_l)} |f^T(b(f_l)\otimes a(x_k(f_l),f_l)) - g(x_k(f_l),f_l)|^2 + \sum_{x_m(f_l)} \left|f^T(b(f_l)\otimes a_n(x_k(f_l),f_l)) - \frac{\partial g(x_m,f_l)}{\partial n}\right|^2\right) \tag{1.20}$$

By expanding the inner summations inside the optimization problem (1.20), it can be expressed as $$\min_f f^T Re(A+A_n)f - 2f^T Re\{d+d_n\} + c \tag{1.21}$$

where Re(.) denotes the real part of a complex number and the matrices A, $A_n$ are defined, respectively, as $$A \triangleq \sum_{f_l} \alpha_{f_l}\left(\sum_{x_k(f_l)} (b(f_l)\otimes a(x_k(f_l),f_l))(b(f_l)\otimes a(x_k(f_l),f_l))^H\right), \tag{1.22}$$

$$A_n \triangleq \sum_{f_l} \alpha_{f_l}\left(\sum_{x_k(f_l)} (b(f_l)\otimes a_n(x_m(f_l),f_l))(b(f_l)\otimes a_n(x_m(f_l),f_l))^H\right), \tag{1.23}$$

and the vectors d, and $d_n$, are defined, respectively, as $$d \triangleq \sum_{f_l} \alpha_{f_l}\left(\sum_{x_k(f_l)} (b(f_l)\otimes a(x_k(f_l),f_l))\cdot g(x_k(f_l),f_l)^*\right), \tag{1.24}$$

$$d_n \triangleq \sum_{f_l} \alpha_{f_l}\left(\sum_{x_m(f_l)} (b(f_l)\otimes a_n(x_m(f_l),f_l))\cdot \frac{\partial g(x_m f_l)^*}{\partial n}\right), \tag{1.25}$$

and the constant c is defined as $$c \triangleq \sum_{f_l} \alpha_{f_l}\left(\sum_{x_k(f_l)} |g(x_k(f_l),f_l)|^2 + \sum_{x_m(f_l)} \left|\frac{\partial g(x_m,f_l)^*}{\partial n}\right|^2\right) \tag{1.26}$$

Since the coefficient c is not a function of the filter coefficients, the configuration of optimal FIR filters, i.e., the optimization problem (1.21), can further simplified as the following quadratic programming $$\min_f f_T Re(A_T)f - 2f^T Re\{d_T\} \tag{1.27}$$

where $A_T \triangleq A+A_n$ and $d_T \triangleq d+d_n$.

Fortunately, the optimization problem (1.27) is convex and it can be solved using convex optimization techniques with polynomial time worst-case complexity. Such use of convex optimization is within the capability of one skilled in the art, now informed by the present disclosure. Thus, in some implementations, determining the set of filter coefficients whose respective values globally minimize the total difference between the combined speaker transfer function and the idealized transfer function of an idealized virtual point source at a specified notional position includes determining a solution to a convex optimization problem, and in particular implementations, the solution is a convergently iterative numerical solution.

It is also possible to find closed-form solutions for the optimization problem (1.27) which makes it possible to implement the proposed wave-field synthesis algorithm in real-time. Specifically, for the case that $Re(A_T)$ is invertible, the globally optimal solution of the problem (1.27) can be obtained by equating the gradient of the objective function in optimization problem (1.27) to zero. By doing so, the optimal solution in this case can be expressed as $$f^* = Re(A_T)^{-1}\cdot Re(d_T) \tag{1.28}$$

For the case where matrix $Re(A_T)$ is not invertible, the globally optimal solution of problem (1.27) is a specific linear combination of the eigenvectors of the matrix $Re(A_T)$ that correspond to non-zero eigenvalues plus an arbitrary linear combination of the eigenvectors of $Re(A_T)$ that correspond to zero eigenvalues. Consider eigenvalue decomposition of the matrix $Re(A_T)$ as $$Re(A_T)=U^{H\Lambda U} \tag{1.29}$$

in which $\Lambda=diag(\lambda_1, \lambda_2, \ldots \lambda_{M,N})$, denotes a diagonal matrix whose $i^{th}$ diagonal element, i.e., $\lambda_i$, equals $i^{th}$ eigenvalue of the matrix $Re(A_T)$ in a descending order ($\lambda_1 \geq \lambda_2 \geq \lambda_3 \geq \ldots \geq \lambda_{MN}$). Moreover, $U=[u_1\ u_2\ \ldots\ U_{MN}]$ is a unitary matrix constructed based on the eigenvectors of the matrix $Re(A_T)$. More specifically, $i^{th}$ column of the matrix U, i.e., $u_i$, equals the normalized eigenvector of $Re(A_T)$ that corresponds to $i^{th}$ eigenvalue of matrix $Re(A_T)$, i.e., $\lambda_i$.

Since the matrix $Re(A_T)$ is rank deficient, the unitary matrix U can be decomposed as $U=[U_1\ U_2]$, where $U_1$ denotes the set of eigenvectors corresponding to non-zero eigenvalues while $U_2$ denotes the set of eigenvectors that correspond to the zero eigenvalues. Since the matrix U is unitary, its columns can span the entire space of $\mathbb{R}^{MN}$. Accordingly, every feasible solution of the problem (1.27) can be expressed as a linear combination of the columns of U or, equivalently, as the columns of $U_1$ and $U_2$ as $$f=U_1\cdot\alpha+U_2\cdot\beta \tag{1.30}$$

It should be emphasized that the vectors $\alpha$ and $\beta$ in equation (1.30) are real vectors due to the fact that the matrix $Re(A_T)$ is real symmetric and f is a real vector. By substituting (1.30), into the optimization problem (1.27), this problem can be equivalently expressed as $$\min_{\alpha\beta}\alpha^T\Lambda_1\alpha-2(U_1\cdot\alpha+U_2\cdot\infty)^T Re\{d_T\} \tag{1.31}$$

where $\Lambda_1$ is a diagonal matrix which includes the non-zero eigenvalues of the matrix $Re(A_T)$ as its diagonal elements. Optimization problem (1.21), and accordingly optimization problem (1.27), are lower-bounded which implies that the optimization problem (1.31) should also be lower-bounded. Based on this, $U_2^T Re\{d_T\}$ should be equal to zero otherwise the problem (1.31) is not lower-bounded. As a result, the globally optimal solution of the problem (1.31) is equal to $$f^*=U_1\cdot\alpha^*+U_2\cdot\beta \tag{1.32}$$

where $\beta$ can be chosen arbitrarily and $\alpha^*$ is the globally optimal solution of the following problem $$\min_{\alpha}\alpha^T\Lambda_1\alpha-2(U_1\cdot\alpha)^T Re\{d_T\} \tag{1.33}$$

By setting the gradient of the objective function in problem above to zero, the $\alpha^*$ can be obtained as $$\alpha^*=\Lambda_1^{-1}U_1^T Re\{d_T\} \tag{1.34}$$

Note that it is possible to add additional constraints into the problem (1.21) and solve the resulting optimization problem via convex optimization techniques. For instance, the following additional constraints might be added to the optimization problem (1.21):

Adding Optimization Constraints to Remove the Low-Frequency Components (Bass Signal) Linear-Phase Constraints on Each Filter In order to demonstrate the efficacy of the above-described method, exemplary numerical results are given. The configuration of the speakers, virtual point source, and the preferred desired listening region has been set according to FIG. 5. More specifically, the notional convexly-bounded listening region is assumed to be planar as noted above and further assumed to be bounded by a circular curve with radius one and with a center located at the origin of the Cartesian coordinate system. Additionally eight speakers (used for synthesizing a virtual point source) are assumed to be uniformly located over the line that connects the point (−0.5185,2) to the end point (−0.5185,2) while the virtual point source is assumed to be located at (0.3, 3).

The eight speakers are modeled as omnidirectional and the speaker transfer function of the ith speaker (i=1, 2, . . . , 8) located at $x_i=(-0.5185+(i-1)\times 0.1481,2)$ is mathematically modelled as $$Q_i(x, f_l) = \frac{1}{4\pi|x-x_i|}e^{-j\frac{2\pi f_l}{c}|x-x_i|} \tag{1.35}$$

where x denotes the measurement location. The directional gradient of $Q_i(x,f_l)$ in equation (1.35) can be expressed as $$\frac{\partial Q_i(x, f_l)}{\partial n} = -\frac{1}{4\pi|x-x_i|}e^{-j\frac{2\pi f_l}{c}|x-x_i|}\left(\frac{1}{|x-x_i|}+j\frac{2\pi f_l}{c}\right)\frac{(x-x_i)^T n}{|x-x_i|} = -Q_i(x, f_l)\left(\frac{1}{|x-x_i|}+j\frac{2\pi f_l}{c}\right)\frac{(x-x_i)^T n}{|x-x_i|} \tag{1.36}$$

In addition to the speakers, the virtual point source is also modeled as an omnidirectional point source with the same spatial transfer function. In this numerical result, the FIR filter coefficients are configured by considering 100 uniform frequency bins over the interval of $w_0=0$ rad/s and $w_1=19635$ rad/s ($f_d=3125$ Hz). Moreover, the sampling frequency of the audio signal has been assumed to be equal to $f_s=32$ Khz. For each frequency bin, 80 distinct equidistant points are selected on the boundaries of the circular planar listening area and the length of each FIR filter has been fixed to 128. To obtain these results, the closed form expression in (1.32) has been utilized.

As noted above, FIG. 5 shows the configuration of the speakers, virtual point source, and the preferred desired listening area. FIGS. 6 to 11, respectively, show magnitude and phase responses of the synthesized combined speaker transfer function and the idealized transfer function of the virtual point source (which is the target spatial transfer function) over the boundary of the circular planar listening area across three different frequencies, namely, 1963 rad/s, 4909 rad/s, and 7854 rad/s. In these figures, the horizontal axis shows the observation angle as it has been shown in FIG. 2.

Figure 7:
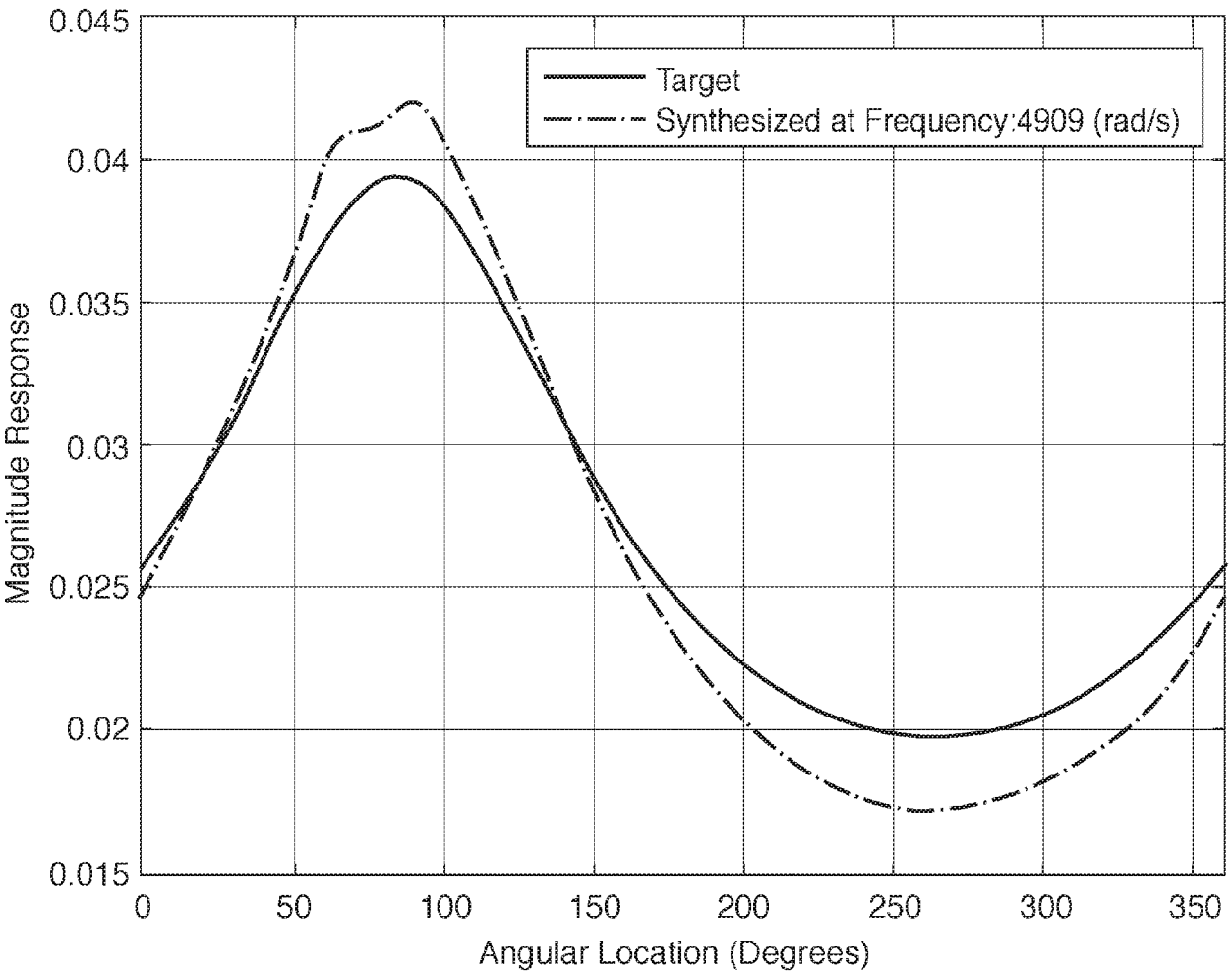
Figure 8:
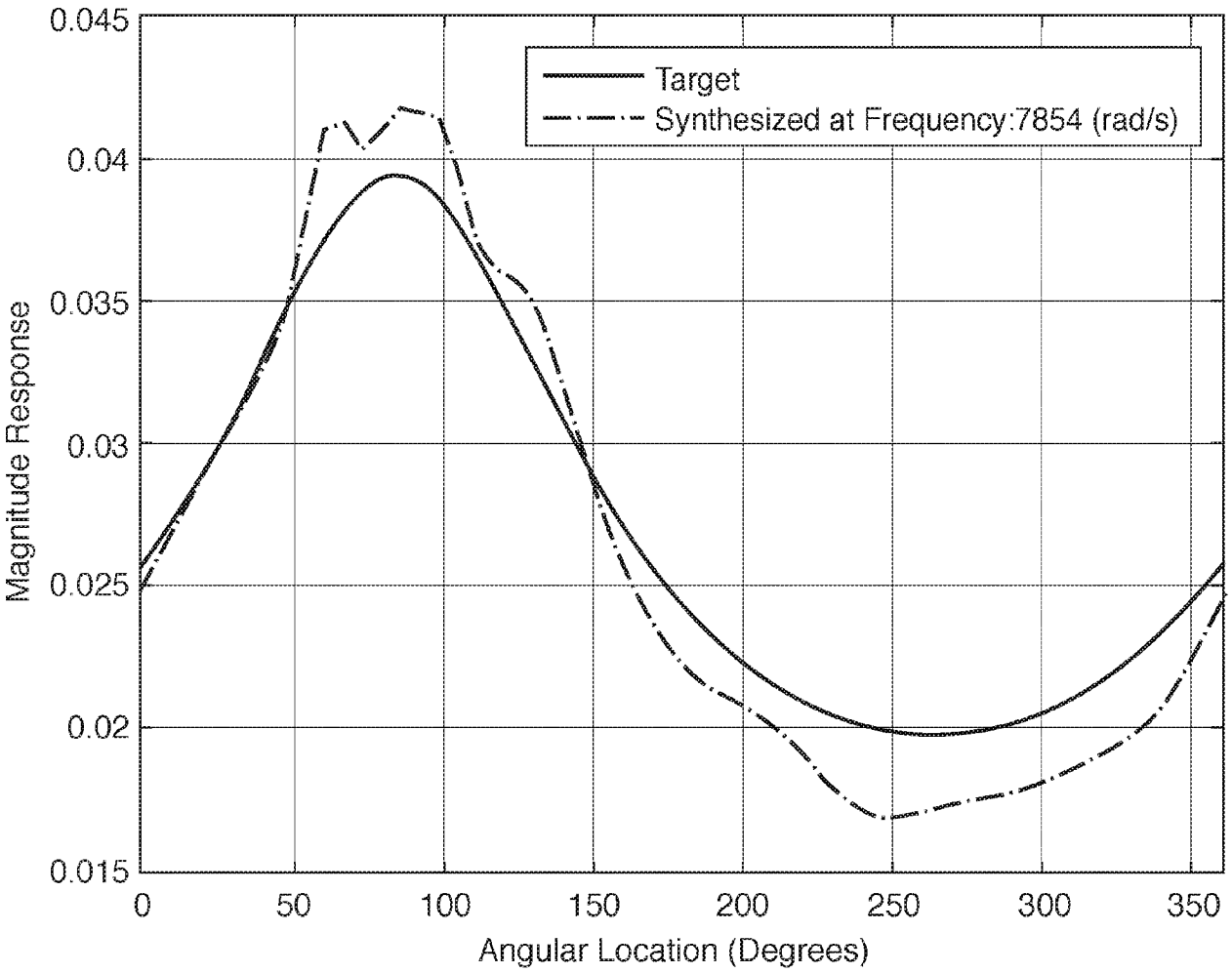
Figure 9:
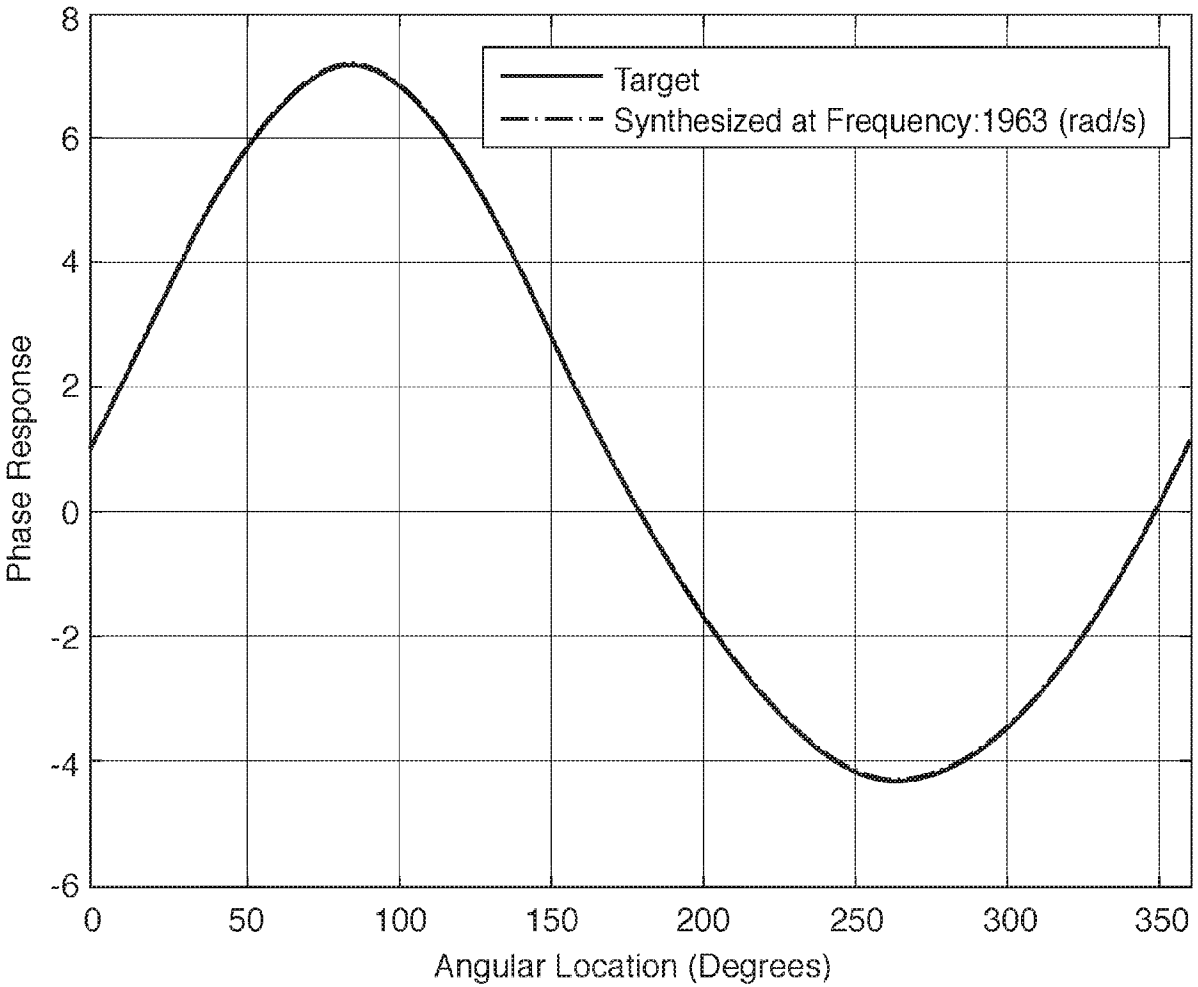
Figure 10:
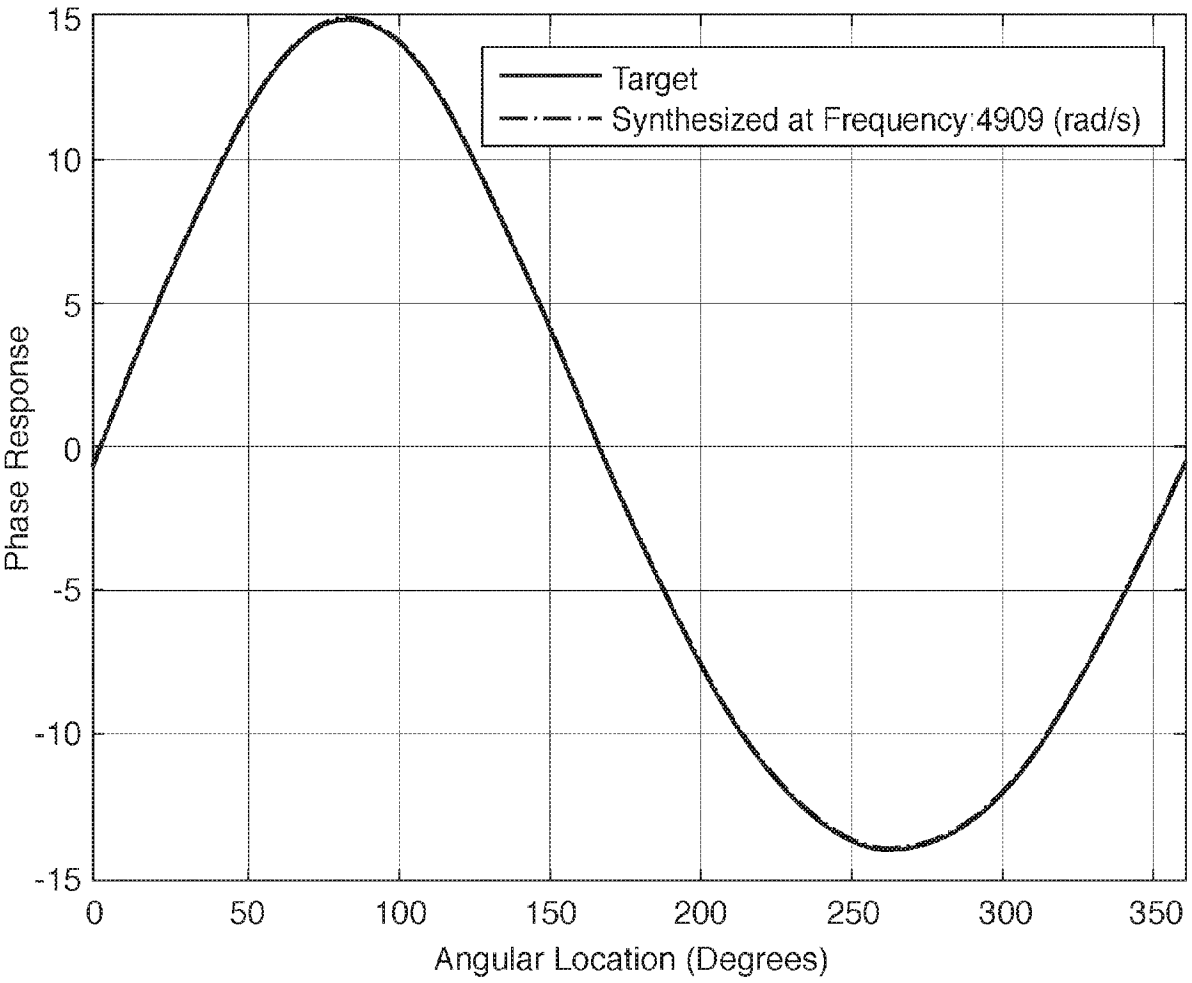
Figure 11:
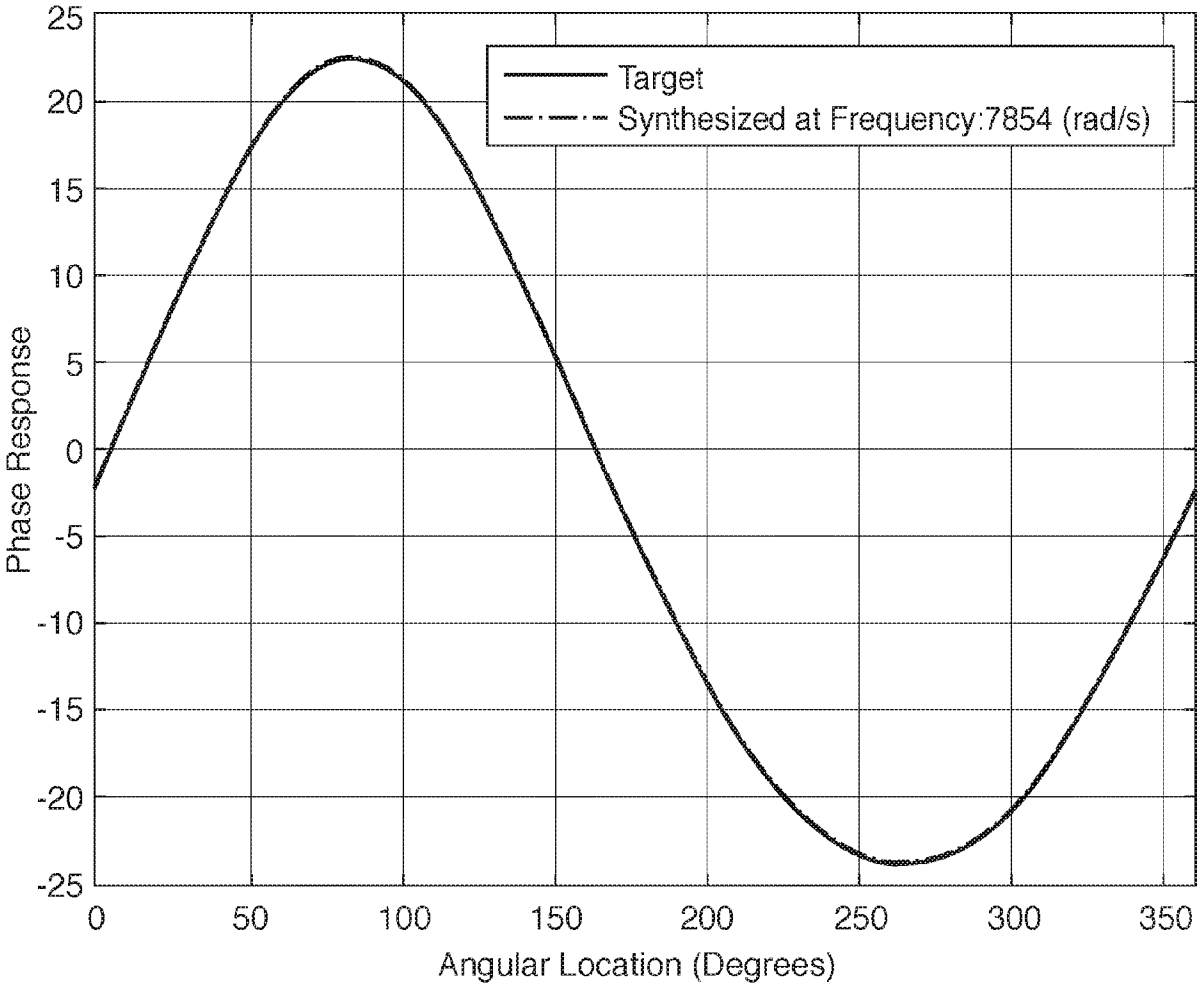

From FIGS. 6, 7, and 8, it can be observed that as the frequency increases the deviation between the magnitude of the (target) idealized transfer function of the virtual point source and the magnitude of the synthesized speaker transfer function increases. However, there is exact overlap between the phase of the synthesized and the (target) idealized transfer function of the virtual point source at all of these frequencies (i.e. between the combined speaker transfer function and the idealized transfer function of the virtual point source).

Figure 12:
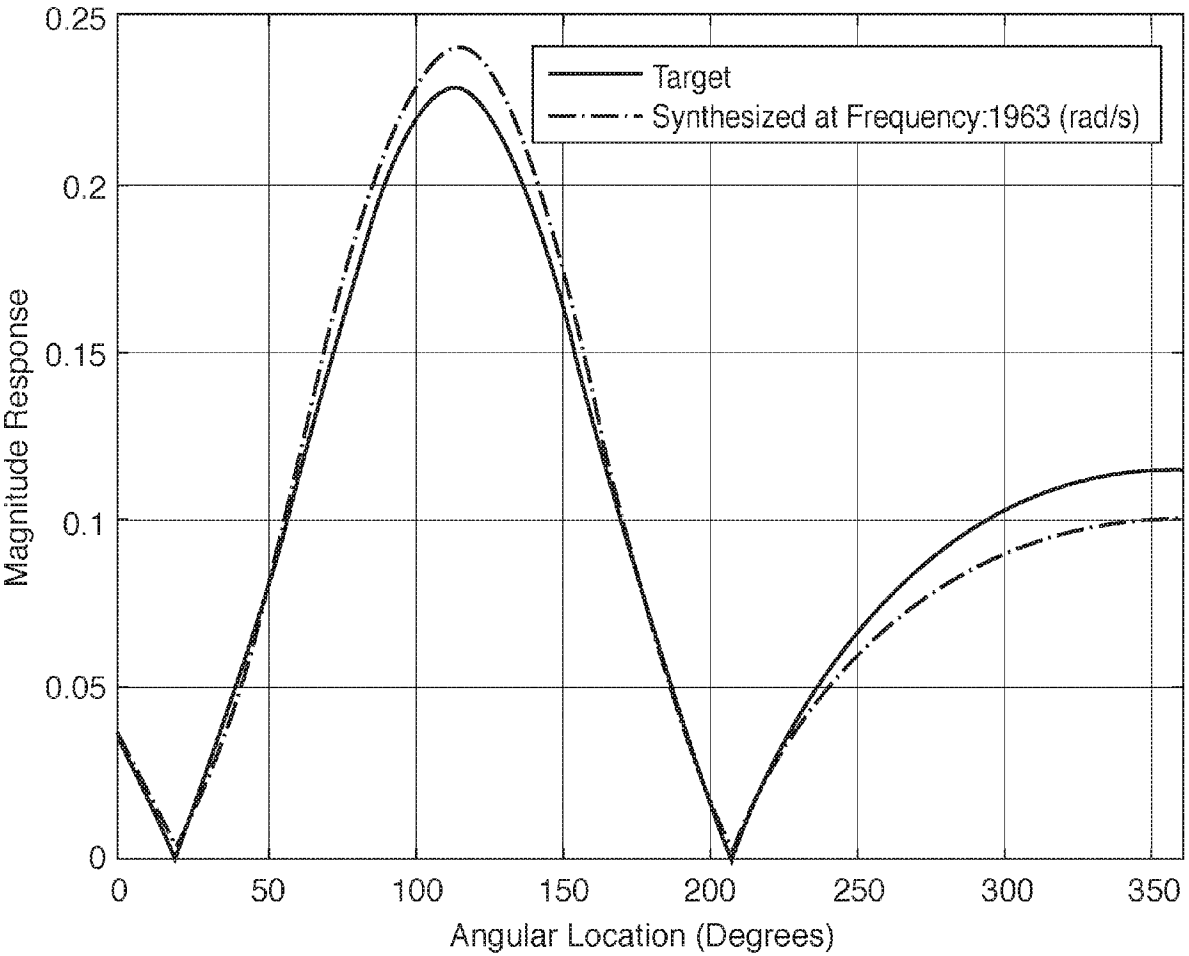
FIGS. 12 to 14 illustrate the magnitude of the directional gradient of the synthesized combined transfer function versus the magnitude of the directional gradient of the idealized transfer function of the virtual point source for the listening region in FIG. 5.
Figure 13:
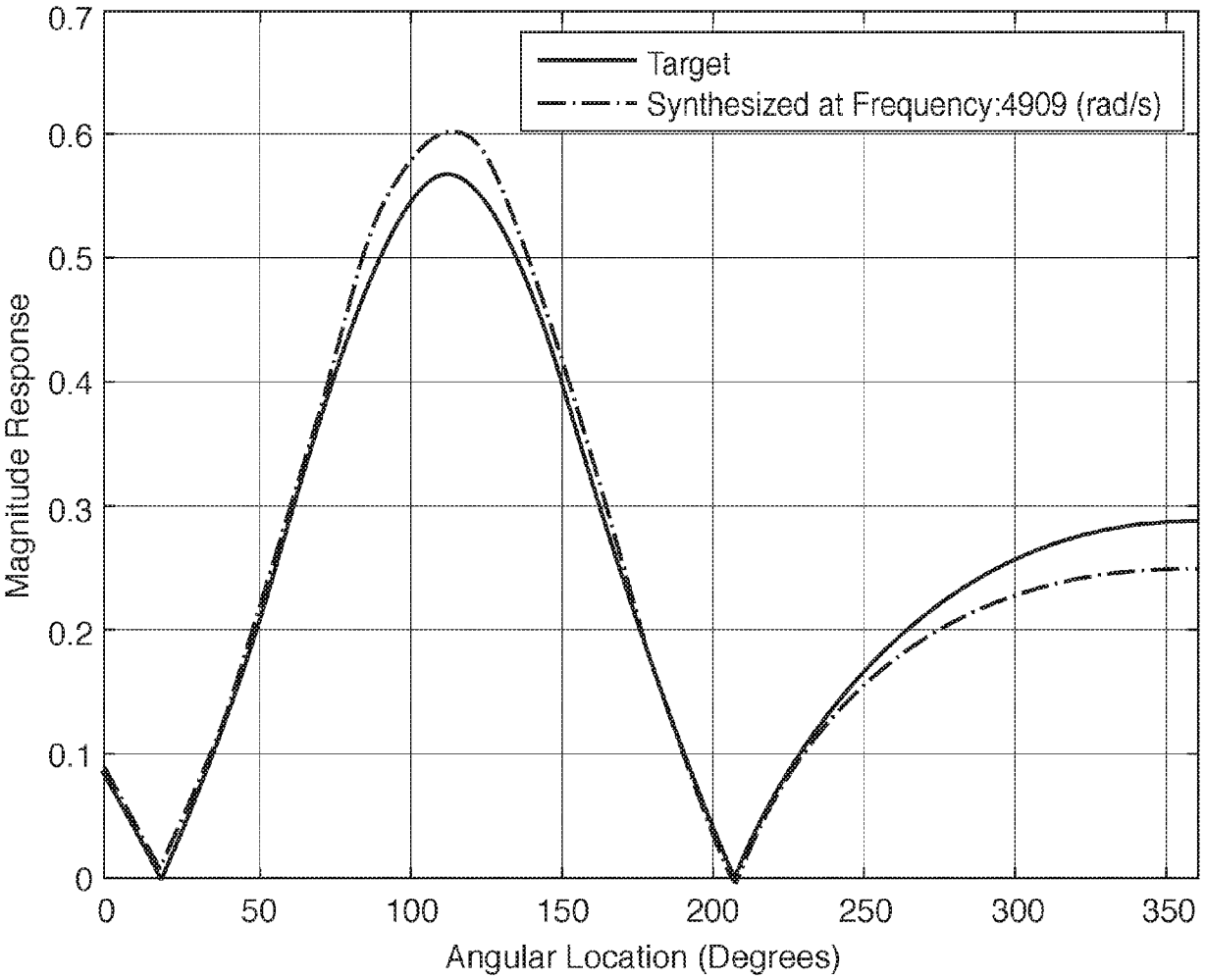
Figure 14:
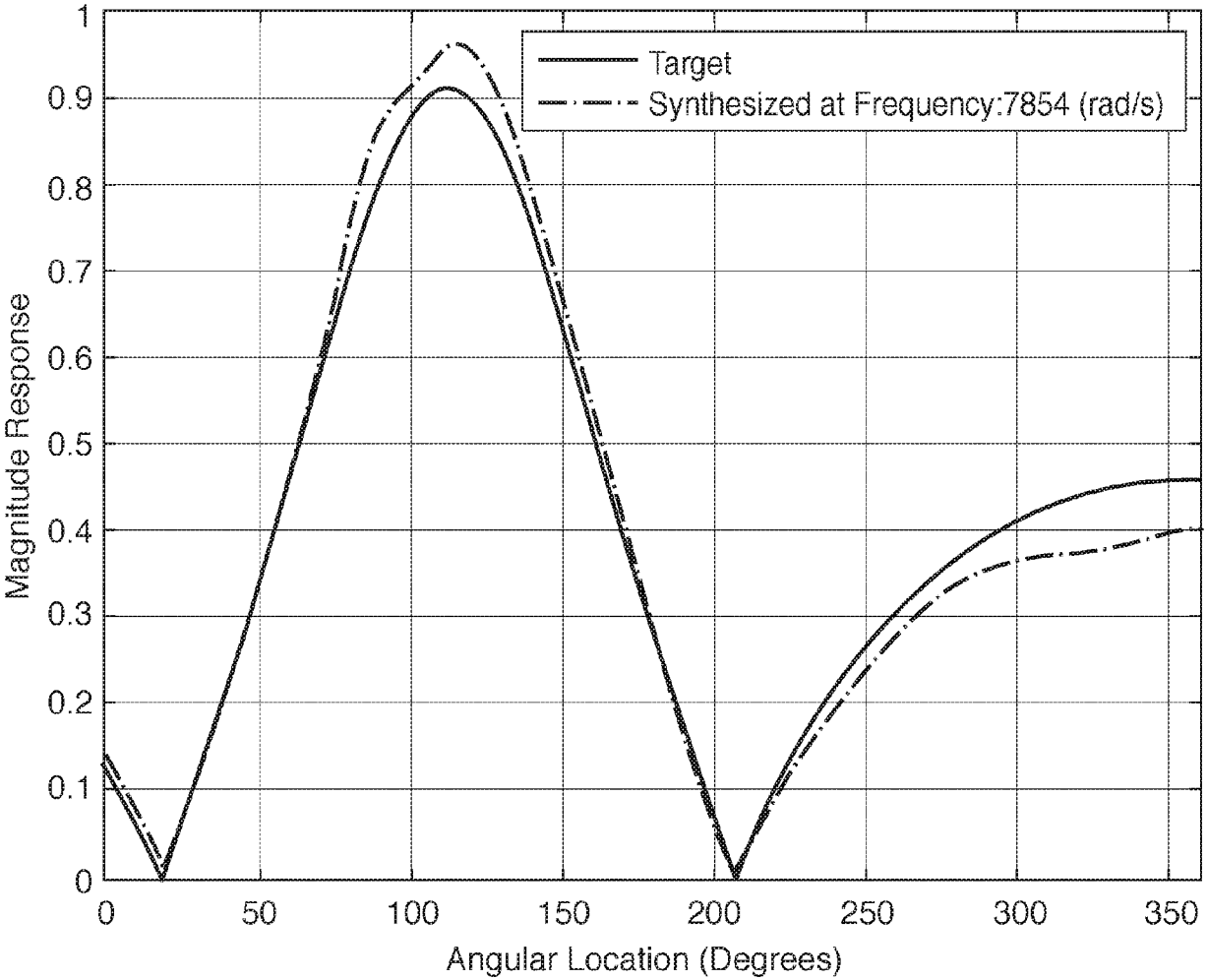

FIGS. 12, 13 and 14 also illustrate the directional gradient of the synthesized combined speaker transfer function compared to the idealized transfer function of the virtual point source. From these figures, it can be also observed that the directional gradient of the combined speaker transfer function which corresponds to the idealized transfer function of the virtual point source has been synthesized with relatively good accuracy.

As noted above, it will be appreciated by one skilled in the art that the methods described herein can be straightforwardly extended to boundaries of a convex volume in three dimensional space.

The present disclosure enables the computer-implementation of methods for optimizing a multi-speaker sound system to simulate at least one idealized virtual point source. Exemplary implementation of such methods will now be described.

Figure 15:
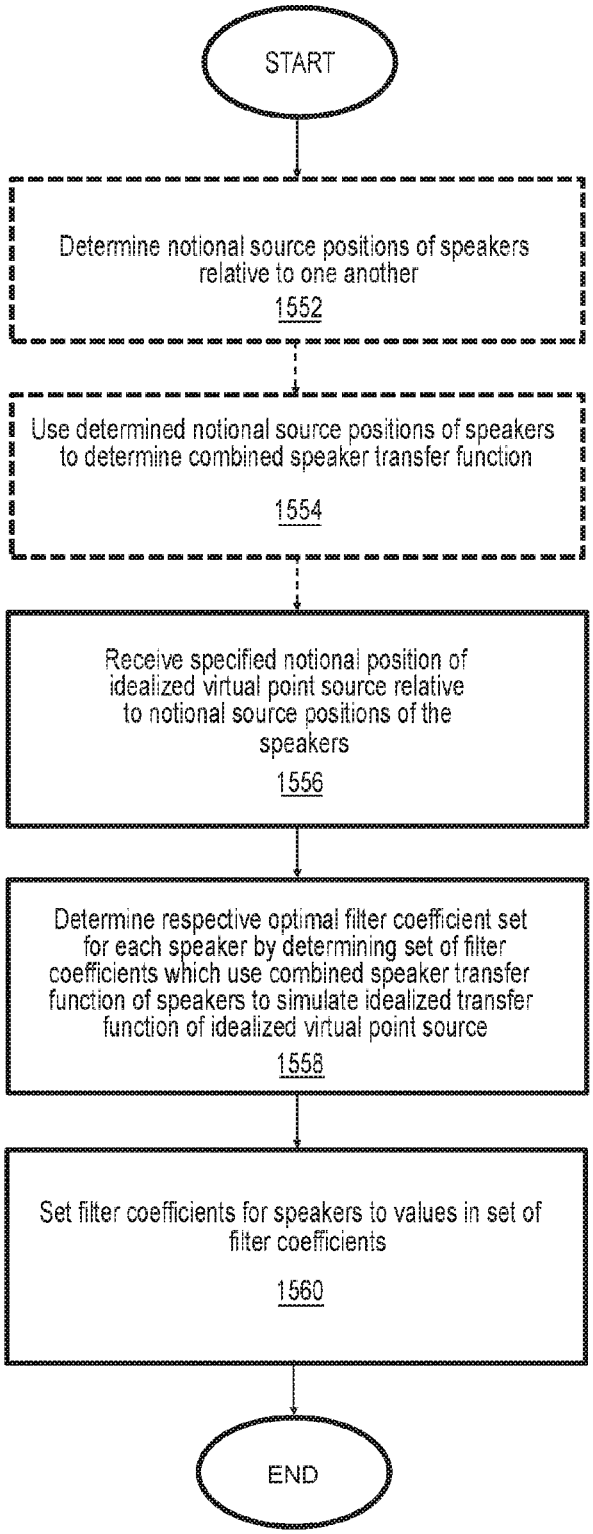
FIG. 15 is a flow chart showing an exemplary computer-implemented method for optimizing a multi-speaker sound system to simulate a single idealized virtual point source that has a variable position relative to the speakers.

FIG. 15 is a flow chart showing an exemplary computer-implemented method 1550 for optimizing a multi-speaker sound system to simulate a single idealized virtual point source that has a variable position relative to the speakers. At step 1556, the method 1550 receives, at one or more processors (i.e. a single processor or a plurality of processors working in cooperation), a specified notional position of an idealized virtual point source relative to notional source positions of the speakers. At step 1558, the method 1550 determines, using the processor(s), a respective optimal filter coefficient set for each speaker by determining a set of filter coefficients which use a combined speaker transfer function of the speakers to simulate an idealized transfer function of the idealized virtual point source. As explained above, the combined speaker transfer function represents superpositioned speaker transfer functions of the speakers at notional test points within a notional convexly-bounded listening region, the notional test points having known test point positions relative to notional source positions of the speakers. Moreover, determining the set of filter coefficients includes determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the idealized transfer function of the idealized virtual point source at the specified notional position of the idealized virtual point source. At step 1560, the method 1550 uses the processor(s) to set the filter coefficients for the speakers to the respective values in the set of filter coefficients. After step 1560, the method 1550 ends.

The exemplary method 1550 can be applied to a system in which the speakers are secured to a carrier with fixed spatial positions relative to one another, or to a system in which the speakers have variable spatial positions relative to one another. Where the speakers have fixed spatial positions relative to one another, the combined speaker transfer function may be a predefined function based on fixed notional source positions of the speakers relative to one another (although predefined, the combined speaker transfer function will depend on the filter coefficients, which are configured as part of the optimization as described above). Where the speakers have variable spatial positions relative to one another, the method 1550 may further include optional steps 1552 and 1554, which are shown in dashed lines and would be carried out prior to step 1556. At step 1552, the method 1550 determines, using the processor(s), the notional source positions of the speakers relative to one another, and at step 1554, the method 1550 uses the determined notional source positions of the speakers relative to one another to determine, using the processor(s), the combined speaker transfer function of the speakers.

As noted above, determining the set of filter coefficients whose respective values globally minimize in frequency domain, across at least a subset of all frequency bins below a sampling frequency limit, across the frequency-sufficient set of the notional test points, a total difference between the combined speaker transfer function and the t idealized transfer function of the idealized virtual point source at the specified notional position of the idealized virtual point source may include determining a solution to a convex optimization problem. This solution may be a convergently iterative numerical solution or may be a closed form solution.

Figure 15A:
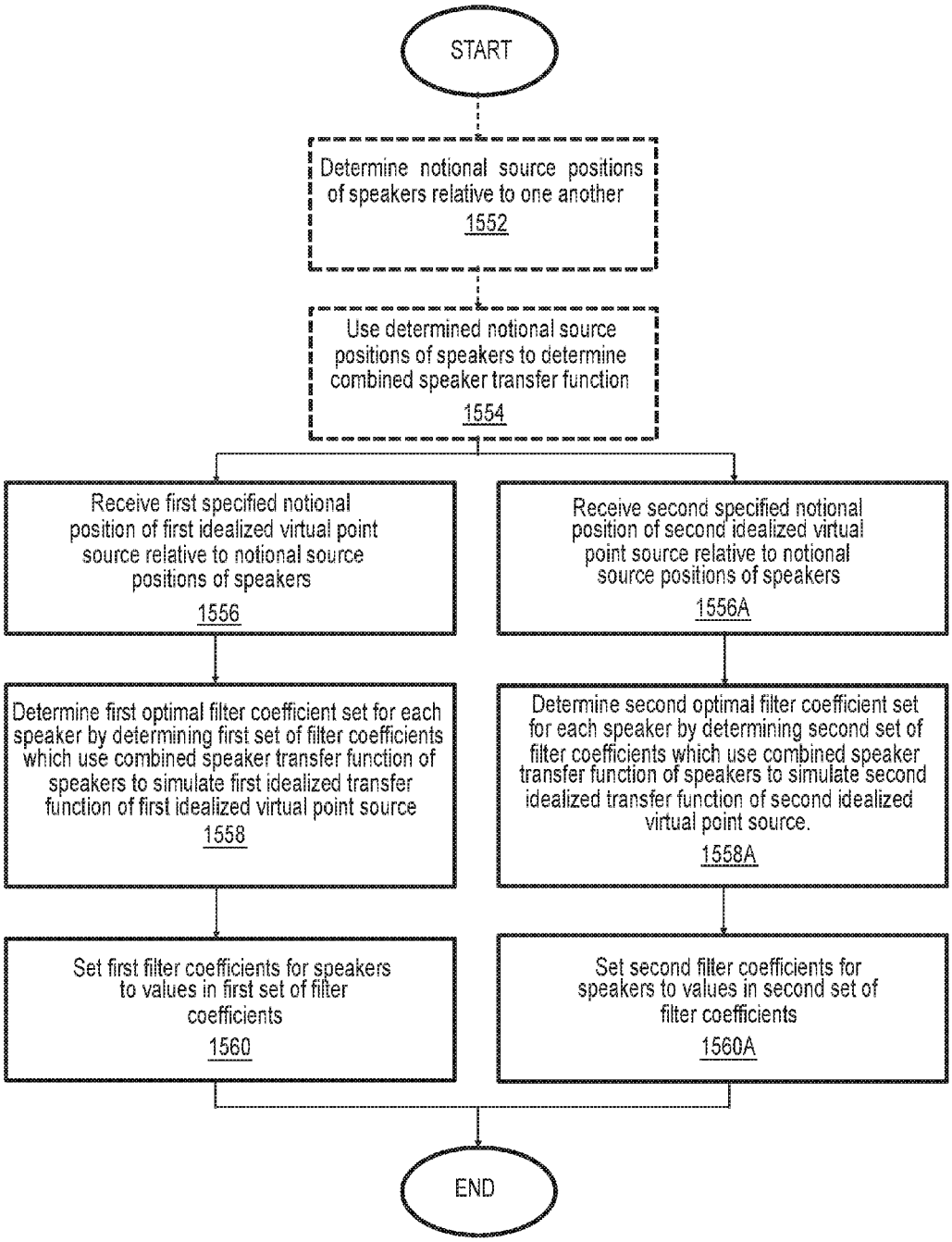
FIG. 15A shows an extension of the method of FIG. 15 to simulate two idealized virtual point sources.
Figure 15B:
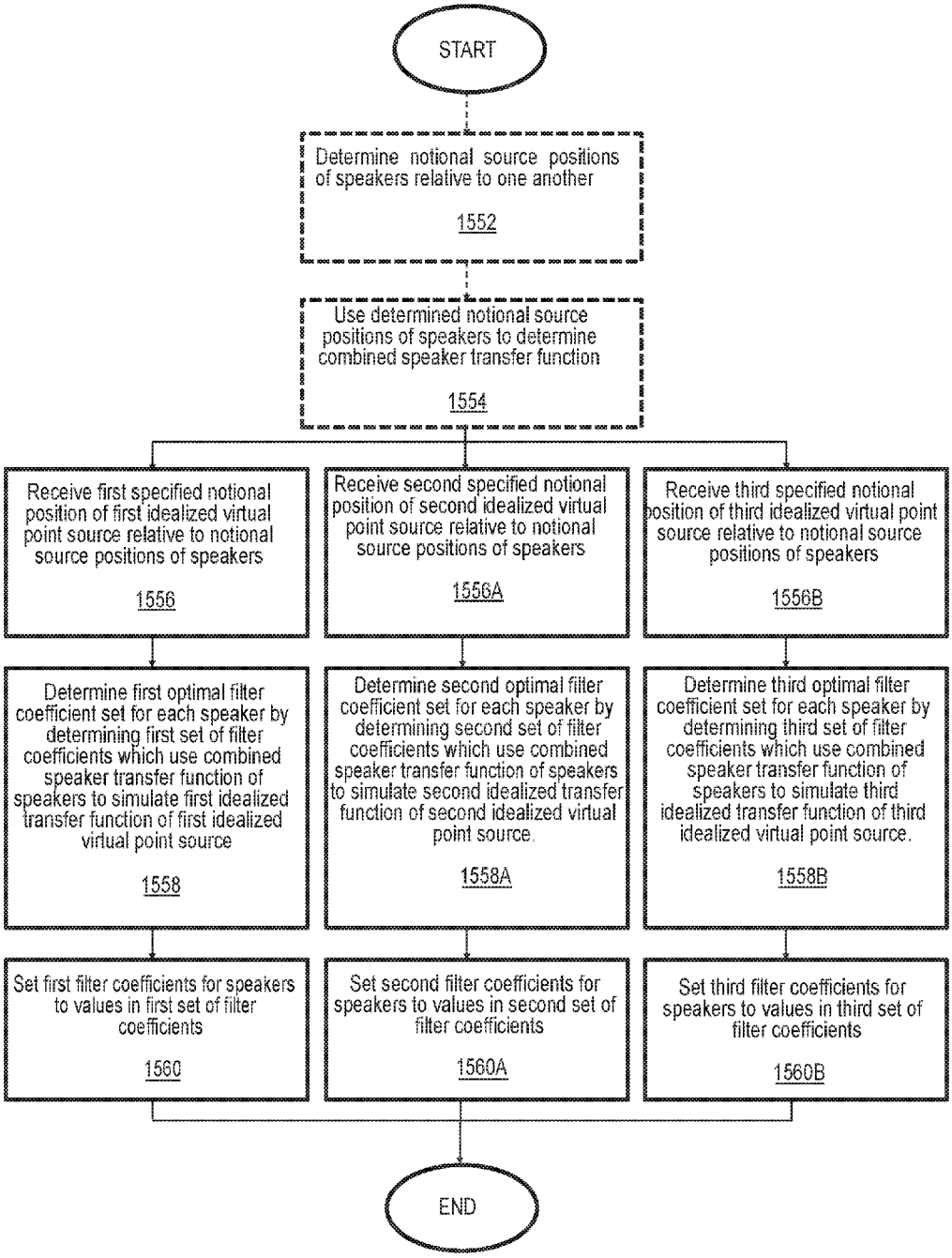
FIG. 15B shows an extension of the method of FIG. 15 to simulate three idealized virtual point sources.

The exemplary method 1550 can be extended to simulate a plurality of idealized virtual point sources having variable positions relative to the speakers. FIG. 15A shows an extension 1550A of the method 1550 to simulate two idealized virtual point sources, and FIG. 15B shows an extension 1550B of the method 1550 to simulate three idealized virtual point sources.

Referring first to FIG. 15A, it can be seen that the method 1550A shown therein is similar to the method 1550 shown in FIG. 15. Where the speakers have variable spatial positions relative to one another, at optional steps 1552 and 1554, which are shown in dashed lines, the method 1550A determines the notional source positions of the speakers relative to one another and uses the determined notional source positions of the speakers relative to one another to determine the combined speaker transfer function of the speakers.

At step 1556, the method 1550A receives, at one or more processors (i.e. a single processor or a plurality of processors working in cooperation), a first specified notional position of a first idealized virtual point source relative to notional source positions of the speakers. At step 1558, the method 1550A determines, using the processor(s), a first respective optimal filter coefficient set for each speaker by determining a first set of filter coefficients which uses a combined speaker transfer function of the speakers to simulate a first idealized transfer function of the first idealized virtual point source. As explained above, the combined speaker transfer function represents superpositioned speaker transfer functions of the speakers at notional test points within a notional convexly-bounded listening region, the notional test points having known test point positions relative to notional source positions of the speakers. Moreover, determining the first set of filter coefficients includes determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the first idealized transfer function of the first idealized virtual point source at the first specified notional position of the first idealized virtual point source. At step 1560, the method 1550A uses the processor(s) to set the first filter coefficients for the speakers to the respective values in the first set of filter coefficients.

In addition, at step 1556A, the method 1550A receives, at one or more processors (i.e. a single processor or a plurality of processors working in cooperation), a second specified notional position of a second idealized virtual point source relative to notional source positions of the speakers. At step 1558A, the method 1550A determines, using the processor (s), a second respective optimal filter coefficient set for each speaker by determining a second set of filter coefficients which use a combined speaker transfer function of the speakers to simulate a second idealized transfer function of the second idealized virtual point source. As with step 1558, the combined speaker transfer function represents superpositioned speaker transfer functions of the speakers at notional test points within a notional convexly-bounded listening region, the notional test points having known test point positions relative to notional source positions of the speakers. Moreover, determining the second set of filter coefficients includes determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the second idealized transfer function of the second idealized virtual point source at the second specified notional position of the second idealized virtual point source. At step 1560A, the method 1550A uses the processor (s) to set the second filter coefficients for the speakers to the respective values in the second set of filter coefficients.

In FIG. 15A, steps 1556A, 1558A and 1560A are shown proceeding in parallel with steps 1556, 1558 and 1560; alternatively these steps may proceed serially or in any suitable order.

Reference is now made to FIG. 15B, which is similar to the method 1550A shown in FIG. 15A but includes additional steps 1556B, 1558B and 1560B to handle simulation of a third idealized virtual point source. In particular, at step 1556B, the method 1550B receives, at one or more processors (i.e. a single processor or a plurality of processors working in cooperation), a third specified notional position of a third idealized virtual point source relative to notional source positions of the speakers. At step 1558B, the method 1550B determines, using the processor(s), a third respective optimal filter coefficient set for each speaker by determining a third set of filter coefficients which use a combined speaker transfer function of the speakers to simulate a third idealized transfer function of the third idealized virtual point source. As with steps 1558 and 1558A, the combined speaker transfer function represents superpositioned speaker transfer functions of the speakers at notional test points within a notional convexly-bounded listening region, the notional test points having known test point positions relative to notional source positions of the speakers. Moreover, determining the third set of filter coefficients includes determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the third idealized transfer function of the third idealized virtual point source at the third specified notional position of the third idealized virtual point source. At step 1560B, the method 1550B uses the processor(s) to set the third filter coefficients for the speakers to the respective values in the third set of filter coefficients.

Analogously to the method 1550A shown in FIG. 15A, steps 1556, 1558 and 1560, steps 1556A, 1558A and 1560A and steps 1556A, 1558A and 1560A, while shown proceeding in parallel may proceed serially or in any suitable order.

While illustrated in respect of a single idealized virtual point source (the method 1500 in FIG. 15), two idealized virtual point sources (the method 1500A in FIG. 15A) and three idealized virtual point sources (the method 1500B in FIG. 15B) methods according to the present disclosure can be extended to four, five or more idealized virtual point sources.

As can be seen from the above description, the multi-speaker sound systems and methods described herein represent significantly more than merely using categories to organize, store and transmit information and organizing information through mathematical correlations. The multi-speaker sound systems and methods are in fact an improvement to the field of audio technology, as they provide for improved simulation of one or more virtual point sources. Moreover, the multi-speaker sound systems and methods are applied by using a particular machine, namely a multi-speaker sound system. As such, the presently claimed technology is confined to multi-speaker sound systems.

The present technology may be embodied within a system, a method, a computer program product or any combination thereof. The computer program product may include a computer readable storage medium or media having computer readable program instructions thereon for causing a processor to carry out aspects of the present technology. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing.

A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may include copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present technology may be assembler instructions, instruction-set-architecture (ISA) instructions, machine instructions, machine dependent instructions, microcode, firmware instructions, state-setting data, or either source code or object code written in any combination of one or more programming languages, including an object oriented programming language or a conventional procedural programming language. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present technology.

Aspects of the present technology are described herein with reference to flowchart illustrations and/or block diagrams of methods, apparatus (systems), and computer program products according to embodiments of the technology. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein includes an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present technology. In this regard, each block in the flowchart or block diagrams may represent a module, segment, or portion of instructions, which includes one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Finally, the terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "includes" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the technology in the form disclosed. Many modifications and variations will be apparent to those of ordinary skill in the art without departing from the scope of the claims. The embodiment was chosen and described in order to best explain the principles of the technology and the practical application, and to enable others of ordinary skill in the art to understand the technology for various embodiments with various modifications as are suited to the particular use contemplated.

One or more currently preferred embodiments have been described by way of example. It will be apparent to persons skilled in the art that a number of variations and modifications can be made without departing from the scope of the technology as defined in the claims.

What is claimed is:

1. A multi-speaker sound system to simulate at least one idealized virtual point source, the system comprising:

at least one source signal input adapted to receive a respective source signal, there being one source signal input associated with each idealized virtual point source;

a plurality of speakers;

each of the speakers being coupled to each source signal input by a respective parallel circuit to direct each respective source signal toward each speaker;

a plurality of filters;

each filter being associated with a single speaker and a single source signal input;

each filter being interposed between its respective speaker and its respective source signal input to filter the respective source signal;

each filter having a respective filter coefficient set;

each speaker having a speaker transfer function for each source signal input, each speaker transfer function for a particular speaker and a particular source signal input representing that speaker's beam pattern as a function of the respective filter coefficient set of the filter associated with that particular speaker and that particular source signal input;

the multi-speaker sound system having a combined speaker transfer function for each source signal input, each combined speaker transfer function for a particular source signal input being a summation in space of the speaker transfer functions of the speakers for that source signal input and representing superpositioned speaker transfer functions of the speakers at notional test points within a notional convexly-bounded listening region;

wherein for each combined speaker transfer function, the filter coefficients have respective values that globally minimize in frequency domain, across at least a subset of all frequency bins below a sampling frequency limit, across a frequency-sufficient set of the notional test points having known test point positions relative to notional source positions of the speakers, a total difference between that particular combined speaker transfer function and an idealized transfer function of that particular idealized virtual point source at a specified notional position of that idealized virtual point source relative to the notional source positions of the speakers.

2. The system of claim 1, wherein the notional convexly-bounded listening region is planar.

3. The system of claim 2, wherein the notional convexly-bounded listening region is circular.

4. The system of claim 1, wherein the speakers are secured to a carrier with fixed spatial positions relative to one another.

5. The system of claim 4, wherein each idealized virtual point source has a predefined fixed position and the filters are preconfigured with their respective filter coefficients.

6. The system of claim 4, further comprising:

at least one processor coupled to the filters;

at least one memory coupled to the at least one processor;

the at least one memory storing test point impingement information representing, across at least a subset of all frequency bins below the sampling frequency limit, at least for each test point in the frequency-sufficient set of the notional test points:

combined speaker transfer function values at the test points; and combined speaker transfer function gradient vector values at the test points;

the at least one memory further storing the idealized transfer function of each idealized virtual point source;

at least one point source adjustment input coupled to the processor and adapted to provide the specified notional position of each idealized virtual point source to the processor;

the at least one memory storing instructions which, when executed by the processor, cause the processor to:

receive, from the at least one point source adjustment input, the specified notional position of that idealized virtual point source;

evaluate the idealized transfer function of that idealized virtual point source for the specified notional position of that idealized virtual point source;

determine, for each source signal input, a set of filter coefficient values that globally minimize in frequency domain, across at least a subset of all frequency bins below a sampling frequency limit, across the frequency-sufficient set of the notional test points, the total difference between the combined speaker transfer function and the idealized transfer function of the idealized virtual point source associated with that particular source signal input at a specified notional position of that idealized virtual point source; and configure the filters to have the determined coefficient values.

7. The system of claim 6, wherein the test point impingement information comprises at least one of:

at least inherent transfer function components of the speaker transfer functions; and the combined speaker transfer function;

whereby the test point impingement information represents the combined speaker transfer function values at the test points by enabling calculation of the combined speaker transfer function values for any arbitrary group of test points.

8. The system of claim 7, wherein:

the test point impingement information comprises the combined speaker transfer function;

whereby the test point impingement information represents the combined speaker transfer function gradient vector values at the test points by enabling calculation of the combined speaker transfer function gradient values at the test points for any arbitrary group of test points.

9. The system of claim 6, wherein the test points are pre-defined test points.

10. The system of claim 9, wherein the test point impingement information represents the combined speaker transfer function values at the test points using pre-calculated test point transfer functions for each test point.

11. The system of claim 9, wherein the test point impingement information represents the combined speaker transfer function gradient vector values at the test points using pre-calculated test point transfer function gradient vectors for each test point.

12. The system of claim 1, further comprising:

at least one processor coupled to the filters;

at least one memory coupled to the at least one processor;

the at least one memory storing the speaker transfer functions;

the at least one memory further storing the idealized transfer function of each idealized virtual point source;

at least one point source adjustment input coupled to the processor and adapted to provide the specified notional position of each idealized virtual point source to the processor;

a speaker localization system coupled to the at least one processor and adapted to determine the notional source positions of the speakers and provide the notional source positions of the speakers to the at least one processor;

the at least one memory storing instructions which, when executed by the processor, cause the processor to:

receive, from the speaker localization system, the notional source positions of the speakers;

determine the combined speaker transfer function for each source signal input from the notional source positions of the speakers;

receive, from the at least one point source adjustment input, the specified notional position of each idealized virtual point source;

evaluate the idealized transfer function of each idealized virtual point source for the specified notional position of that idealized virtual point source;

determine, for each source signal input, a set of filter coefficient values that globally minimize in frequency domain, across at least a subset of all frequency bins below a sampling frequency limit, across the frequency-sufficient set of the notional test points, the total difference between the combined speaker transfer function and the idealized transfer function of the idealized virtual point source at the specified notional position of the idealized virtual point source associated with that particular source signal input; and configure the filters to have the determined coefficient values.

13. A method for optimizing a multi-speaker sound system to simulate at least one idealized virtual point source, the method comprising:

receiving, at least one processor, a first specified notional position of a first idealized virtual point source relative to notional source positions of the speakers;

determining, by the at least one processor, a first respective optimal filter coefficient set for each speaker by determining a first set of filter coefficients which use a combined speaker transfer function of the speakers to simulate a first idealized transfer function of the first idealized virtual point source, wherein:

the combined speaker transfer function represents superpositioned speaker transfer functions of the speakers at notional test points within a notional convexly-bounded listening region, the notional test points having known test point positions relative to notional source positions of the speakers; and determining the first set of filter coefficients comprises determining a set of filter coefficients whose respective values globally minimize in frequency domain, across at least a subset of all frequency bins below a sampling frequency limit, across a frequency-sufficient set of the notional test points having known test point positions relative to notional source positions of the speakers, a total difference between the combined speaker transfer function and the first idealized transfer function of the first idealized virtual point source at the first specified notional position of the first idealized virtual point source, setting, by the processor, the first filter coefficients for the speakers to the respective values in the first set of filter coefficients.

14. The method of claim 13, wherein the notional convexly-bounded listening region is planar.

15. The method of claim 13, wherein the notional convexly-bounded listening region is circular.

16. The method of claim 13, wherein the combined speaker transfer function is a predefined function based on fixed notional source positions of the speakers relative to one another.

17. The method of claim 13, further comprising:

determining, by the at least one processor, the notional source positions of the speakers relative to one another; and the at least one processor using the determined notional source positions of the speakers relative to one another to determine the combined speaker transfer function of the speakers.

18. The method of claim 13, wherein the at least one idealized virtual point source is a single virtual point source.

19. The method of claim 13, wherein the at least one idealized virtual point source is two virtual point sources, the method further comprising:

receiving, at the at least one processor, a second specified notional position of a second idealized virtual point source relative to the notional source positions of the speakers;

determining, by the at least one processor, a second respective optimal filter coefficient set for each speaker by determining a second set of filter coefficients which use the combined speaker transfer function to simulate a second idealized transfer function of the second idealized virtual point source, wherein:

determining the second set of filter coefficients comprises determining a set of filter coefficients whose respective values globally minimize in frequency domain, across at least a subset of all frequency bins below a sampling frequency limit, across the frequency-sufficient set of the notional test points, a total difference between the combined speaker transfer function and the second idealized transfer function of the second idealized virtual point source at the second specified notional position of the second idealized virtual point source;

setting, by the processor, the second filter coefficients for the speakers to the respective values in the second set of filter coefficients.

20. The method of claim 13, wherein the at least one idealized virtual point source is three virtual point sources, the method further comprising:

receiving, at the at least one processor, a second specified notional position of a second idealized virtual point source relative to the notional source positions of the speakers;

determining, by the at least one processor, a second respective optimal filter coefficient set for each speaker by determining a second set of filter coefficients which use the combined speaker transfer function to simulate a second idealized transfer function of the second idealized virtual point source, wherein:

determining the second set of filter coefficients comprises determining a set of filter coefficients whose respective values globally minimize in frequency domain, across at least a subset of all frequency bins below a sampling frequency limit, across the frequency-sufficient set of the notional test points, a total difference between the combined speaker transfer function and the second idealized transfer function of the second idealized virtual point source at the second specified notional position of the second idealized virtual point source;

setting, by the processor, the second filter coefficients for the speakers to the respective values in the second set of filter coefficients;

receiving, at the at least one processor, a third specified notional position of a third idealized virtual point source relative to the notional source positions of the speakers;

determining, by the at least one processor, a third respective optimal filter coefficient set for each speaker by determining a third set of filter coefficients which use the combined speaker transfer function to simulate a third idealized transfer function of the third idealized virtual point source, wherein:

determining the third set of filter coefficients comprises determining a set of filter coefficients whose respective values globally minimize in frequency domain, across at least a subset of all frequency bins below a sampling frequency limit, across the frequency-sufficient set of the notional test points, a total difference between the combined speaker transfer function and the third idealized transfer function of the third idealized virtual point source at the third specified notional position of the third idealized virtual point source;

setting, by the processor, the third filter coefficients for the speakers to the respective values in the third set of filter coefficients.

21. The method of claim 13, wherein the at least one idealized virtual point source is at least four idealized virtual point sources.

22. The method of claim 13, wherein determining the set of filter coefficients whose respective values globally minimize in frequency domain, across at least a subset of all frequency bins below a sampling frequency limit, across the frequency-sufficient set of the notional test points, a total difference between the combined speaker transfer function and the first idealized transfer function of the first idealized virtual point source at the first specified notional position of the first idealized virtual point source comprises determining a solution to a convex optimization problem.

23. The method of claim 22, wherein the solution is a convergently iterative numerical solution.

24. The method of claim 22, wherein the solution is a closed form solution.

* * * * *